US008944552B2

(12) United States Patent
Yasutani

(10) Patent No.: US 8,944,552 B2
(45) Date of Patent: Feb. 3, 2015

(54) INKJET PRINTING APPARATUS AND DETERMINATION METHOD OF DRIVING PULSE APPLIED TO INKJET PRINTING APPARATUS

(71) Applicant: Canon Kabushiki Kaisha, Tokyo (JP)

(72) Inventor: Jun Yasutani, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 13/644,787

(22) Filed: Oct. 4, 2012

(65) Prior Publication Data

US 2013/0120484 A1 May 16, 2013

(30) Foreign Application Priority Data

Nov. 16, 2011 (JP) ..... 2011-251022

(51) Int. Cl.
*B41J 29/38* (2006.01)
*B41J 2/045* (2006.01)
*B41J 29/02* (2006.01)

(52) U.S. Cl.
CPC ..... *B41J 2/04563* (2013.01); *B41J 29/02* (2013.01); *B41J 2/04543* (2013.01); *B41J 2/04551* (2013.01); *B41J 2/0458* (2013.01); *B41J 2/04588* (2013.01); *B41J 2/04591* (2013.01); *B41J 2/04598* (2013.01)
USPC ..... 347/14; 347/11; 347/17

(58) Field of Classification Search
CPC ..... B41J 29/38; B41J 2/365; B41J 9/50; B41J 2/04501; B41J 2/04563; B41J 2/04568; B41J 2/0458; B41J 2/04591; B41J 2/0459; B41J 2/04551
USPC ..... 347/9, 11–14, 17, 19, 40, 44, 56, 57
See application file for complete search history.

(56) References Cited

U.S. PATENT DOCUMENTS 6,422,677 B1 * 7/2002 Deshpande et al. ..... 347/14

FOREIGN PATENT DOCUMENTS

JP 5-31905 A 2/1993

* cited by examiner

*Primary Examiner* — Thinh Nguyen
(74) *Attorney, Agent, or Firm* — Fitzpatrick, Cella, Harper & Scinto

(57) ABSTRACT

An inkjet printing apparatus includes a printhead including a temperature sensor and an element array formed by arraying a plurality of heat generation elements each of which generates a thermal energy required to discharge an ink in response to application of a driving pulse, a specifying unit configured to specify a portion used in printing of the element array, and a selection unit configured to select a driving pulse to be applied to the respective heat generation elements based on the portion specified by the specifying unit and a temperature of the printhead measured by the temperature sensor.

15 Claims, 21 Drawing Sheets

FIG. 6A

LEVEL(1)

| | PULSE WIDTH OF DRIVING PULSE | USED TEMPERATURE RANGE [°C] | TARGET INK DISCHARGE AMOUNT [ng] |
|---|---|---|---|
| LEVEL(1)-PWM5 | | 30.0 ≤ T < 31.0 | 3.80(30.5°C) |
| LEVEL(1)-PWM4 | | 31.0 ≤ T < 32.0 | 3.80(31.5°C) |
| LEVEL(1)-PWM3 | | 32.0 ≤ T < 33.0 | 3.80(32.5°C) |
| LEVEL(1)-PWM2 | | 33.0 ≤ T < 34.0 | 3.80(33.5°C) |
| LEVEL(1)-PWM1 | | 34.0 ≤ T < 35.0 | 3.80(34.5°C) |

FIG. 6B

LEVEL(2)

| | PULSE WIDTH OF DRIVING PULSE | USED TEMPERATURE RANGE [°C] | TARGET INK DISCHARGE AMOUNT [ng] |
|---|---|---|---|
| LEVEL(2)-PWM5 | | 30.0 ≤ T < 31.0 | 3.80(30.5°C) |
| LEVEL(2)-PWM4 | | 31.0 ≤ T < 32.0 | 3.85(31.5°C) |
| LEVEL(2)-PWM3 | | 32.0 ≤ T < 33.0 | 3.90(32.5°C) |
| LEVEL(2)-PWM2 | | 33.0 ≤ T < 34.0 | 3.95(33.5°C) |
| LEVEL(2)-PWM1 | | 34.0 ≤ T < 35.0 | 4.00(34.5°C) |

FIG. 6C

LEVEL(3)

| | PULSE WIDTH OF DRIVING PULSE | USED TEMPERATURE RANGE [°C] | TARGET INK DISCHARGE AMOUNT [ng] |
|---|---|---|---|
| LEVEL(3)-PWM5 | | 30.0 ≤ T < 31.0 | 3.80(30.5°C) |
| LEVEL(3)-PWM4 | | 31.0 ≤ T < 32.0 | 3.90(31.5°C) |
| LEVEL(3)-PWM3 | | 32.0 ≤ T < 33.0 | 4.00(32.5°C) |
| LEVEL(3)-PWM2 | | 33.0 ≤ T < 34.0 | 4.10(33.5°C) |
| LEVEL(3)-PWM1 | | 34.0 ≤ T < 35.0 | 4.20(34.5°C) |

FIG. 6D

LEVEL(4)

| | PULSE WIDTH OF DRIVING PULSE | USED TEMPERATURE RANGE [°C] | TARGET INK DISCHARGE AMOUNT [ng] |
|---|---|---|---|
| LEVEL(4)-PWM5 | | 30.0 ≤ T < 31.0 | 3.80(30.5°C) |
| LEVEL(4)-PWM4 | | 31.0 ≤ T < 32.0 | 4.00(31.5°C) |
| LEVEL(4)-PWM3 | | 32.0 ≤ T < 33.0 | 4.20(32.5°C) |
| LEVEL(4)-PWM2 | | 33.0 ≤ T < 34.0 | 4.40(33.5°C) |
| LEVEL(4)-PWM1 | | 34.0 ≤ T < 35.0 | 4.60(34.5°C) |

FIG. 8A

| | NUMBER OF USED NOZZLES | | | |
|---|---|---|---|---|
| | 769~1024 | 513~768 | 257~512 | 1~256 |
| DRIVING PULSE TABLE (LEVEL) | LEVEL(1) 0[ng]/°CUp | LEVEL(2) 0.05[ng]/°CUp | LEVEL(3) 0.10[ng]/°CUp | LEVEL(4) 0.20[ng]/°CUp |

FIG. 8B

| | | USED NOZZLES | NUMBER OF PASSES |
|---|---|---|---|
| PRINT QUALITY | FINE | 256 | 16 PASSES |
| | NORMAL | 768 | 12 PASSES |
| | QUICK | 1024 | 8 PASSES |

FIG. 11

| | | ENVIRONMENTAL TEMPERATURE | | | | | | | |
|---|---|---|---|---|---|---|---|---|---|
| | | ~8.5°C | 9.0~12.0°C | 12.5~15.5°C | 16.0~19.0°C | 19.5~22.5°C | 23.0~26.0°C | 26.5~29.5°C | 30.0°C~ |
| ΔT° | ~1.5deg | PWM16 | PWM16 | PWM16 | PWM16 | PWM15 | PWM13 | PWM11 | PWM10 |
| | 2.0~3.5deg | PWM16 | PWM16 | PWM16 | PWM15 | PWM14 | PWM12 | PWM10 | PWM9 |
| | 4.0~5.5deg | PWM16 | PWM16 | PWM16 | PWM14 | PWM13 | PWM11 | PWM9 | PWM8 |
| | 6.0~7.5deg | PWM16 | PWM16 | PWM15 | PWM13 | PWM12 | PWM10 | PWM8 | PWM7 |
| | 8.0~9.5deg | PWM16 | PWM16 | PWM14 | PWM12 | PWM11 | PWM9 | PWM7 | PWM6 |
| | 10.0~11.5deg | PWM16 | PWM15 | PWM13 | PWM11 | PWM10 | PWM8 | PWM6 | PWM5 |
| | 12.0~13.5deg | PWM16 | PWM14 | PWM12 | PWM10 | PWM9 | PWM7 | PWM5 | PWM4 |
| | 14.0~15.5deg | PWM16 | PWM13 | PWM11 | PWM9 | PWM8 | PWM6 | PWM4 | PWM3 |
| | 16.0~17.5deg | PWM15 | PWM12 | PWM10 | PWM8 | PWM7 | PWM5 | PWM3 | PWM2 |
| | 18.0~19.5deg | PWM14 | PWM11 | PWM9 | PWM7 | PWM6 | PWM4 | PWM2 | PWM1 |
| | 20.0~21.5deg | PWM13 | PWM10 | PWM8 | PWM6 | PWM5 | PWM3 | PWM1 | PWM0 |
| | 22.0~23.5deg | PWM12 | PWM9 | PWM7 | PWM5 | PWM4 | PWM2 | PWM0 | PWM0 |
| | 24.0~25.5deg | PWM11 | PWM8 | PWM6 | PWM4 | PWM3 | PWM1 | PWM0 | PWM0 |
| | 26.0~27.5deg | PWM10 | PWM7 | PWM5 | PWM3 | PWM2 | PWM0 | PWM0 | PWM0 |
| | 28.0~29.5deg | PWM9 | PWM6 | PWM4 | PWM2 | PWM1 | PWM0 | PWM0 | PWM0 |
| | 30.0deg~ | PWM8 | PWM5 | PWM3 | PWM1 | PWM0 | PWM0 | PWM0 | PWM0 |

FIG. 12

| | SIMULTANEOUS HEAT LEVEL (NUMBER OF SIMULTANEOUS DISCHARGE) | | | | | |
|---|---|---|---|---|---|---|
| | LEVEL 0 (0~15 DISCHARGES) | LEVEL 1 (16~31 DISCHARGES) | LEVEL 2 (32~47 DISCHARGES) | LEVEL 3 (48~63 DISCHARGES) | LEVEL 4 (64~79 DISCHARGES) | LEVEL 5 (80~95 DISCHARGES) |
| P1 (PRE-HEAT PULSE WIDTH) [μsec] | 0.219 | 0.219 | 0.219 | 0.219 | 0.219 | 0.219 |
| P2(INTERVAL) [μsec] | 0.688 | 0.688 | 0.677 | 0.677 | 0.667 | 0.646 |
| P3 (MAIN-HEAT PULSE WIDTH) [μsec] | 0.646 | 0.464 | 0.656 | 0.656 | 0.667 | 0.688 |

| | SIMULTANEOUS HEAT LEVEL (NUMBER OF SIMULTANEOUS DISCHARGE) | | | | | | | | |
|---|---|---|---|---|---|---|---|---|---|
| (96~111 DISCHARGES) | (112~127 DISCHARGES) | (128~143 DISCHARGES) | (144~159 DISCHARGES) | (160~175 DISCHARGES) | (176~191 DISCHARGES) | (192~207 DISCHARGES) | (208~223 DISCHARGES) | (224~239 DISCHARGES) | (240~256 DISCHARGES) |
| 0.208 | 0.208 | 0.208 | 0.208 | 0.208 | 0.208 | 0.208 | 0.208 | 0.208 | 0.208 |
| 0.646 | 0.646 | 0.635 | 0.625 | 0.615 | 0.604 | 0.604 | 0.594 | 0.583 | 0.583 |
| 0.698 | 0.698 | 0.708 | 0.719 | 0.729 | 0.740 | 0.740 | 0.750 | 0.760 | 0.760 |

FIG. 14

| SHEET | QUALITY | USED NOZZLES | USED NOZZLE POSITION | NUMBER OF PASSES |
|---|---|---|---|---|
| SHEET A | FINE | 258 | Array4 | 16 PASSES |
| | NORMAL | 768 | Array2+3+4 | 12 PASSES |
| | QUICK | 1024 | Array1+2+3+4 | 8 PASSES |
| SHEET B | FINE | 256 | Array1 | 16 PASSES |
| | NORMAL | 768 | Array1+2+3 | 12 PASSES |
| | QUICK | 1024 | Array1+2+3+4 | 8 PASSES |

FIG. 15

| | | NUMBER OF USED NOZZLES | | |
|---|---|---|---|---|
| | | 769~1024 | 513~768 | 257~512 | 1~256 |
| DRIVING PULSE TABLE (LEVEL) | SHEET A (G1) | LEVEL (1) 0[ng]/°CUp | LEVEL (3) 0.1[ng]/°CUp | LEVEL (3) 0.1[ng]/°CUp | LEVEL (4) 0.2[ng]/°CUp |
| | SHEET B (G2) | LEVEL (1) 0[ng]/°CUp | LEVEL (2) 0.05[ng]/°CUp | LEVEL (3) 0.1[ng]/°CUp | LEVEL (4) 0.2[ng]/°CUp |

INKJET PRINTING APPARATUS AND DETERMINATION METHOD OF DRIVING PULSE APPLIED TO INKJET PRINTING APPARATUS

BACKGROUND OF THE INVENTION

1. Field of the Invention

The present invention relates to an inkjet printing apparatus and a determination method of a driving pulse applied to an inkjet printing.

2. Description of the Related Art

A printing apparatus, which adopts an inkjet printing system, forms an image by repeating an operation for scanning a printhead having orifices used to discharge an ink with respect to a printing medium, and an operation for conveying the printing medium in a direction perpendicular to the printhead scanning direction. Such printhead includes heat generation elements (heaters) for generating a thermal energy upon application of driving pulses.

In a printing apparatus of a type which discharges an ink using such heaters, the ink is film-boiled using the thermal energy generated by applying driving pulses to the heaters, and is discharged using pressures of bubbles generated at that time. For this reason, as a printing operation progresses, the temperature of the printhead gradually increases. Since ink viscosity decreases with increasing temperature, an ink discharge amount changes if the printing operation is continued under the same condition.

For this reason, control is executed to change a head driving pulse signal according to a change in temperature of a substrate (to be also referred to as a head temperature hereinafter) so as to maintain a constant ink discharge amount. Japanese Patent Laid-Open No. 05-31905 discloses a technique for selecting a pulse width of a driving pulse to be applied to the heaters according to a temperature measured by a temperature sensor included in the printhead.

In this case, upon execution of printing while reducing the number of used nozzles, that is, the number of used heaters, when the pulse width of the driving pulse is changed, as described in Japanese Patent Laid-Open No. 05-31905, it is revealed that the following harmful effects occur.

FIGS. 24A and 24B are graphs prepared by plotting lightness levels on a printing medium when the pulse width of the driving pulse is changed. The ordinate plots lightness levels, and the abscissa plots the position of the printing medium. FIG. 24A shows a change in lightness when the printing operation is executed using 768 nozzles. FIG. 24B shows a change in lightness when the printing operation is executed using 1024 nozzles (all nozzles).

With reference to these results, as can be seen from FIG. 24B, a change in lightness after the pulse width of the driving pulse is changed is moderate when the number of used nozzles is larger. On the other hand, as can be seen from FIG. 24A, a change in lightness after the pulse width of the driving pulse is changed is sharp when the number of used nozzles is reduced.

This is because when the number of used nozzles is reduced, a conveyance amount of the printing medium per scan of the printhead is decreased, and a change in ink discharge amount occurs within a narrow area on the printing medium. When a change in lightness occurs within a narrow area on the printing medium, the user visually confirms it as uneven density on the printing medium.

The present invention has been made in consideration of the aforementioned problems, and has as its object to provide a technique for obscuring uneven density to be visually confirmed.

SUMMARY OF THE INVENTION

Accordingly, the present invention is conceived as a response to the above-described disadvantages of the conventional art.

For example, an inkjet printing apparatus and control method thereof according to this invention are capable of obscuring uneven density to be visually confirmed.

According to one aspect of the present invention, there is provided an inkjet printing apparatus comprising: a printhead including a temperature sensor and an element array formed by arraying a plurality of heat generation elements each of which generates a thermal energy required to discharge an ink in response to application of a driving pulse; a specifying unit configured to specify a portion used in printing of the element array; and a selection unit configured to select a driving pulse to be applied to the respective heat generation elements based on the portion specified by the specifying unit and a temperature of the printhead measured by the temperature sensor.

According to one aspect of the present invention, there is provided a determination method applied to a driving pulse of an inkjet printing apparatus including a printhead including a temperature sensor and an element array formed by arraying a plurality of heat generation elements each of which generates a thermal energy required to discharge an ink in response to application of a driving pulse, the method comprising: specifying a portion used in printing of the element array; measuring a temperature of the printhead using the temperature sensor; and selecting a driving pulse to be applied to the heat generation elements based on the portion specified in the specifying and the temperature of the printhead measured in the measuring.

Further features of the present invention will become apparent from the following description of exemplary embodiments (with reference to the attached drawings).

BRIEF DESCRIPTION OF THE DRAWINGS

FIGS. 6A, 6B, 6C and 6D show examples of the relationships between pulse widths and target ink discharge amounts of respective levels in driving pulse tables;

FIG. 8A shows the relationship between the numbers of used nozzles and driving pulse tables according to the first embodiment;

FIG. 8B is a table showing the relationship between the numbers of used nozzles and print modes according to the first embodiment;

FIG. 11 shows an example of a driving pulse table;

FIG. 12 shows an example of a correction table;

FIG. 14 is a table showing an example of the relationship between the number of used nozzles and used nozzle position according to the second embodiment;

FIG. 15 shows an example of the relationship between the numbers of used nozzles and driving pulse tables according to the second embodiment;

DESCRIPTION OF THE EMBODIMENTS

An exemplary embodiment of the present invention will now be described in detail in accordance with the accompanying drawings. In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Moreover, "nozzle" generically represents an orifice, a fluid channel which communicates with this orifice, and an element required to generate an energy used to discharge an ink unless otherwise specified.

[Apparatus Arrangement]

Figure 1:
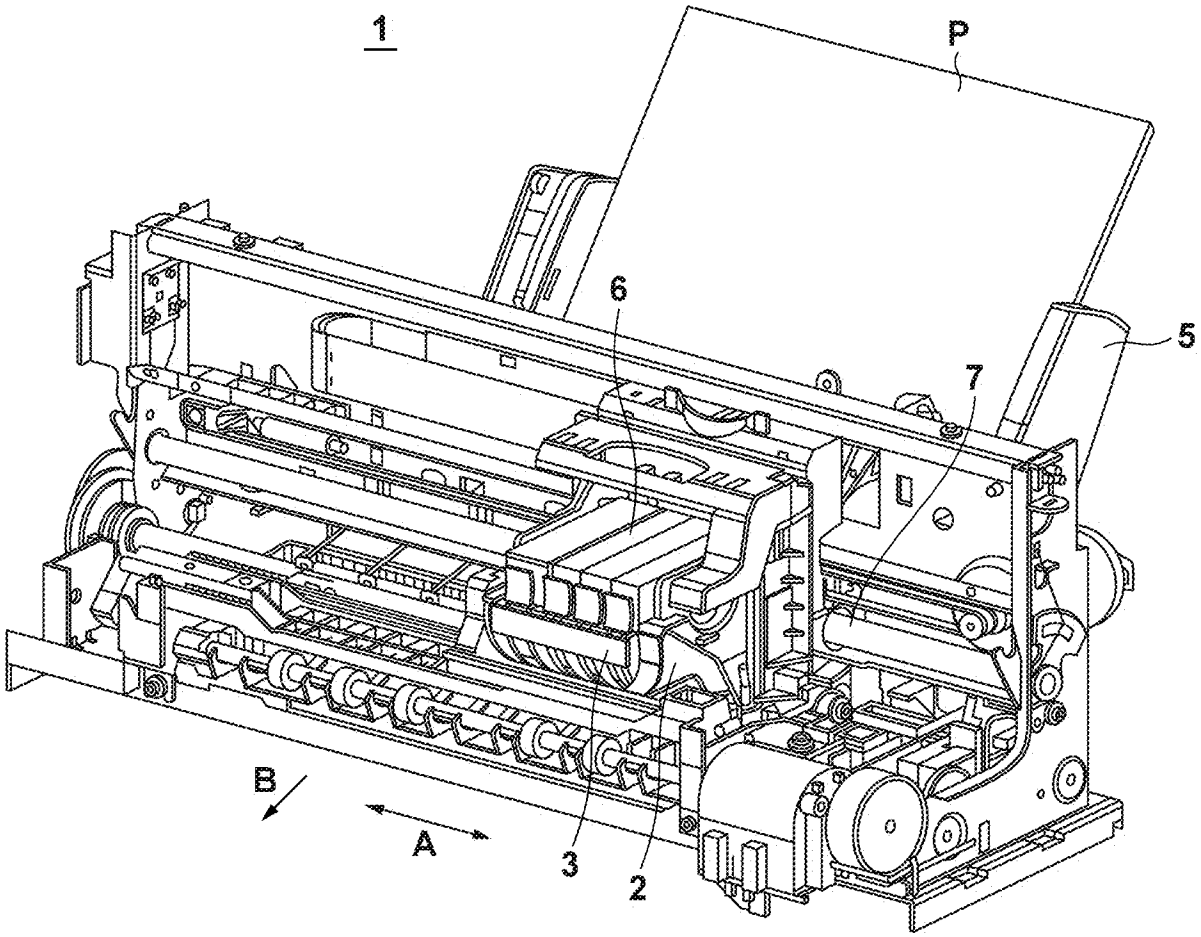
FIG. 1 is a perspective view showing an example of the configuration of a printing apparatus according to an embodiment.

An apparatus arrangement common to some embodiments to be described hereinafter will be described below. FIG. 1 is a perspective view showing an example of the configuration of an inkjet printing apparatus (to be referred to as a printing apparatus hereinafter) according to this embodiment.

A printing apparatus 1 mounts, on a carriage 2, an inkjet printhead (to be referred to as a printhead hereinafter) 3 that performs a printing operation by discharging an ink according to an inkjet method.

The carriage 2 is moved with respect to a printing medium. More specifically, the printing operation is done by reciprocating the carriage 2 along a rail 7 in directions of a double-headed arrow A (in a main scanning direction: a direction perpendicular to the conveyance direction of the printing medium). The printing apparatus 1 feeds a printing medium P such as a printing sheet via a sheet supply mechanism 5, and conveys the printing medium P to a printing position along a direction of an arrow B (sub-scanning direction: the conveyance direction of the printing medium). Then, the printing apparatus 1 performs printing by discharging an ink from the printhead 3 onto the printing medium P at that printing position.

The carriage 2 of the printing apparatus 1 mounts, for example, ink cartridges 6 in addition to the printhead 3. The ink cartridges 6 store inks to be supplied to the printhead 3. Note that the ink cartridges 6 are detachable from the carriage 2.

The printing apparatus 1 shown in FIG. 1 is capable of color printing. For this purpose, four ink cartridges which respectively contain magenta (M), cyan (C), yellow (Y), and black (K) inks are mounted on the carriage 2. These four ink cartridges are independently detachable. Note that light cyan (LC), light magenta (LM), red (R), first black (K1), second black (K2), first gray (G1), second gray (G2), and third gray (G3) inks and the like may be used as a matter of course. In addition, a liquid such as a clear (Cr) ink required to improve image quality may also be used in addition to the aforementioned colored inks.

The printhead 3 includes a print element substrate (heater board). A plurality of nozzle arrays are arrayed on the board. In this embodiment, the arrayed direction of the nozzles agrees with the conveyance direction of the printing medium. The printhead 3 adopts an inkjet system for discharging an ink using a thermal energy. For this purpose, the printhead 3 includes an element array of a plurality of heat generation elements (to be referred to as heaters hereinafter) including electro-thermal transducers and the like, and a control circuit for executing drive control of the heaters. The heaters are arranged in correspondence with nozzles (orifices). For this reason, the element array is arrayed in the same direction as the arrayed direction of the nozzles in the nozzle arrays. When driving pulses are applied to corresponding heaters in accordance with print data, ink droplets are discharged from the nozzles according to energy amounts of the driving pulses.

Figure 2:
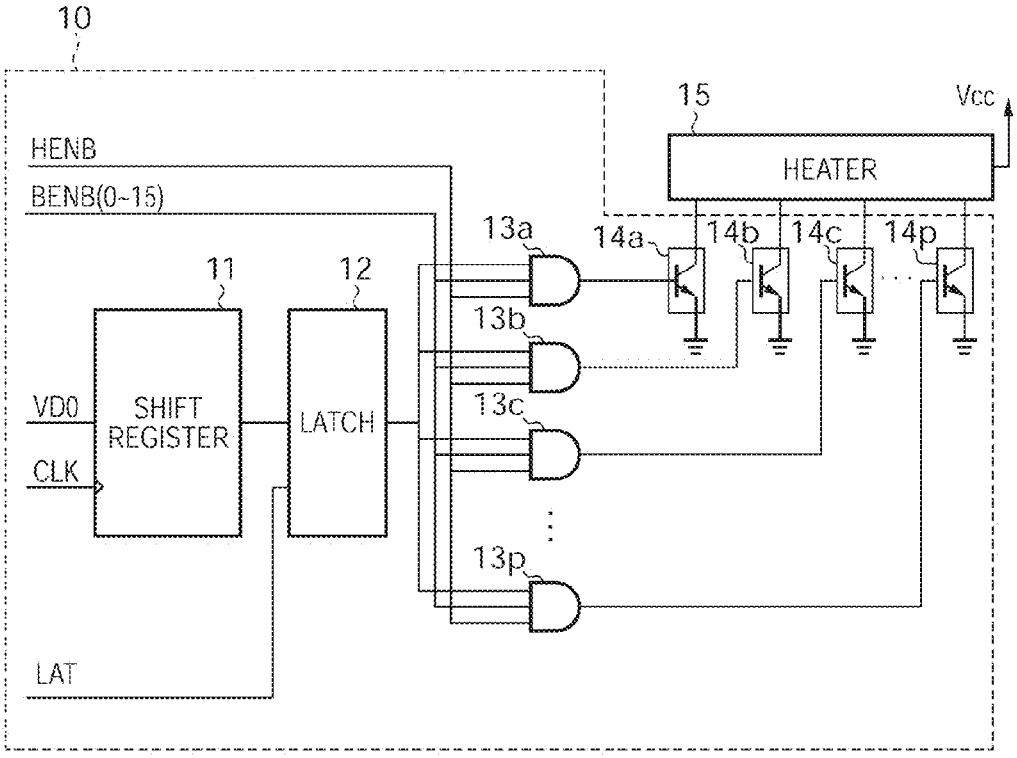
FIG. 2 is a circuit diagram showing an example of the arrangement of a control circuit 10 of a printhead 3.

An example of the arrangement of a control circuit 10 of the printhead 3 shown in FIG. 1 will be described below with reference to FIG. 2. In this case, the arrangement of a control circuit required to drive the printhead 3 having 1024 heaters will be exemplified below.

The control circuit 10 includes a shift register 11, latch circuit 12, AND circuits 13*a* to 13*p*, and driving circuits 14*a* to 14*p*. The control circuit 10 is connected to a plurality of heaters 15. In this case, the plurality of heaters 15 are time-divisionally driven in 16 blocks.

The shift register 11 converts image signals which are input in series into those in parallel. More specifically, the shift register 11 receives serial data of image signals and serial clocks CLK synchronized with these data, and converts them into image signals in parallel for one block.

The latch circuit 12 holds the image signals parallelized by the shift register 11 in synchronism with a latch signal LAT. The AND circuits 13*a* to 13*p* apply driving pulses to the driving circuits 14*a* to 14*p* based on logical products of the outputs from the latch circuit 12, block enable signals BENB0 to BENB15, and a heater driving signal HENB.

The driving circuits 14*a* to 14*p* and the AND circuits 13*a* to 13*p* are arranged in correspondence with the plurality of heaters, and the driving circuits 14*a* to 14*p* apply voltages to the corresponding heaters based on driving pulses applied from the AND circuits 13*a* to 13*p*. Thus, inks are discharged from the corresponding nozzles.

Figure 3:
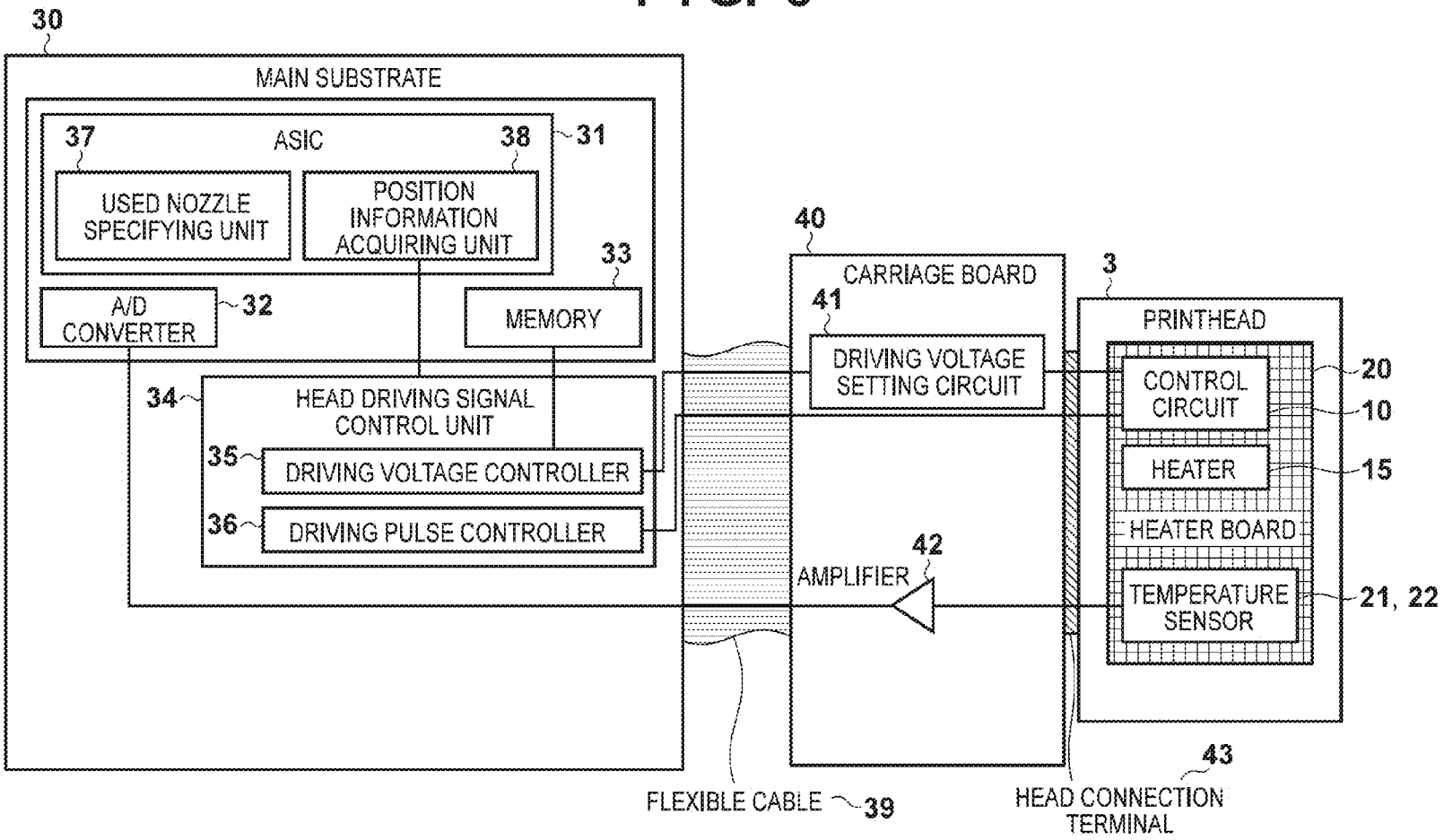
FIG. 3 is a block diagram showing an example of the circuit arrangement in a printing apparatus 1.

An example of the circuit arrangement in the printing apparatus 1 will be described below with reference to FIG. 3. In this case, the circuit arrangement required to control an ink discharge amount in accordance with temperature variations of the printhead 3 will be explained.

A major portion of the printing apparatus 1 includes a main substrate 30. On the main substrate 30, an ASIC 31 and head driving signal control unit 34 are arranged. The ASIC 31 includes an A/D converter 32, memory 33, used nozzle specifying unit 37, and position information acquiring unit 38. The head driving signal control unit 34 includes a driving voltage controller 35 and driving pulse controller 36.

The major portion of the printing apparatus 1 is connected to a carriage board 40 mounted on the carriage 2 via a flexible cable 39. On the carriage board 40, a driving voltage setting circuit 41 and amplifier 42 are arranged.

The carriage board 40 is connected to the printhead 3 via a head connection element 43. On the printhead 3, a heater board 20 is arranged. On the heater board 20, temperature sensors 21 and 22 used to detect the temperature of the printhead 3 (head temperature) are arranged in addition to the control circuit 10 and heaters 15.

The outputs from the temperature sensors 21 and 22 are transferred to the main substrate 30 via the head connection element 43, carriage board 40, and flexible cable 39. At this time, the outputs from the temperature sensors 21 and 22 are amplified by the amplifier 42, and are converted from analog signals into digital signals by the A/D converter 32 incorporated in the ASIC 31. Thus, the ASIC 31 detects a change (increase or decrease) in temperature of the printhead 3 based on a change in digital signal.

Upon detection of such change in head temperature, the ASIC 31 adjusts a driving pulse signal HENB to be applied to the heaters. More specifically, the driving pulse signal is adjusted by a pulse width of the driving pulse or a driving voltage. The pulse width is adjusted by controlling the driving pulse controller 36, and adjustment of the driving voltage is controlled by the driving voltage setting circuit 41 under the control of the driving voltage controller 35.

When the printing apparatus 1 controls an ink discharge amount to be constant in case of an increase in head temperature, it selects a driving pulse of an energy amount which can set a constant ink discharge amount from a driving pulse table stored in the memory 33 such as a RAM according to the measured temperature of the printhead 3.

When a printing operation is executed while changing the number of used nozzles, the driving pulse controller 36 controls a driving pulse based on, for example, the number of used nozzles and used nozzle position. Note that the number of used nozzles is specified by the used nozzle specifying unit 37 in accordance with a print mode. The used nozzle position at that time is acquired by the position information acquiring unit 38.

The driving voltage setting circuit 41 adjusts a driving voltage to be supplied to the heater board 20. In this embodiment, the driving voltage setting circuit 41 is arranged in correspondence with each heater board.

Embodiments of the present invention will be described hereinafter. In the following embodiments, the arrangement for changing an energy amount to be supplied to the heaters by changing the pulse width of the driving pulse will be exemplified. Note that an energy amount to be supplied to the heaters may be changed using the arrangement which executes control using the driving voltage.

First Embodiment

Figure 4A:
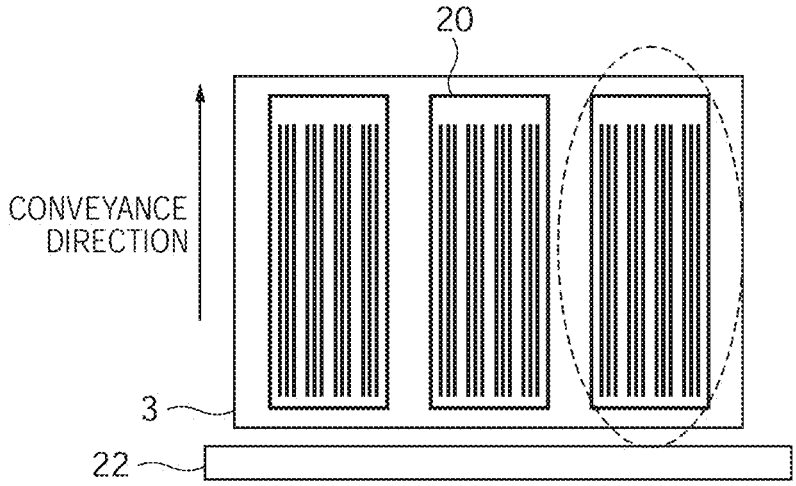
FIG. 4A is a view showing an example of the configuration of the printhead 3.
Figure 4B:
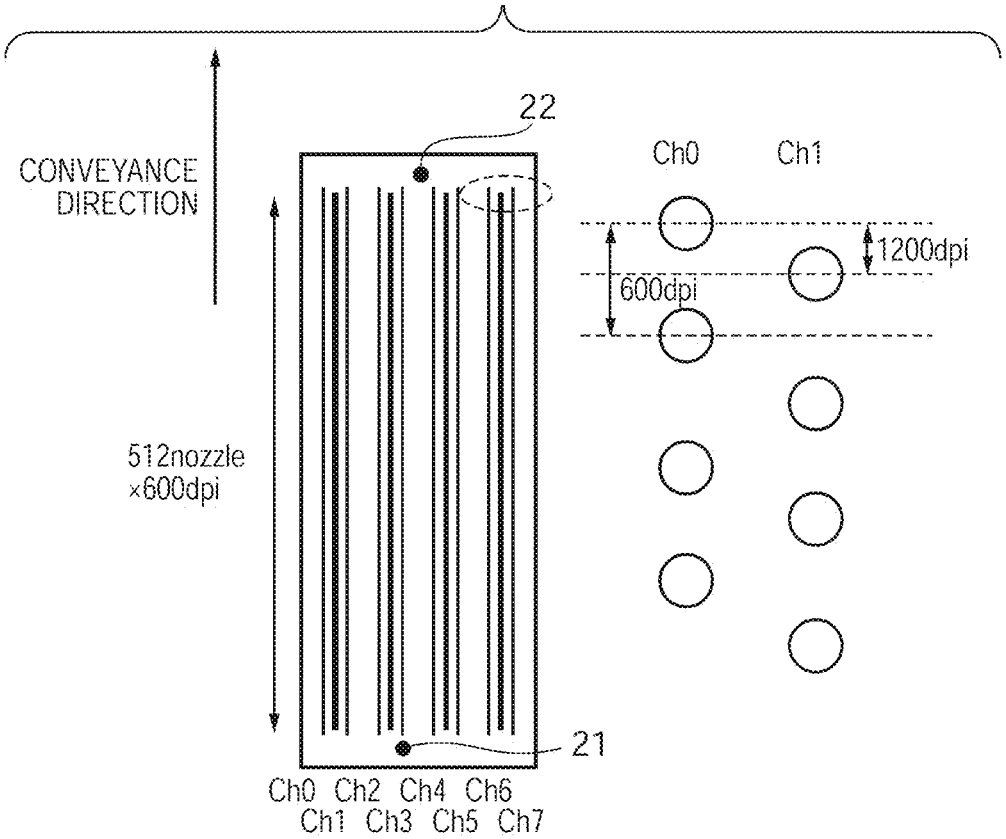
FIG. 4B is a view showing an example of the configuration of a heater board 20.

An example of the configuration of the printhead 3 shown in FIG. 1 will be described below with reference to FIGS. 4A and 4B.

The printhead 3 includes three heater boards 20. On each heater board 20, nozzle arrays including 512 nozzles, which are arrayed at a 600-dpi pitch, are arrayed along the conveyance direction of the printing medium in correspondence with 8 ch, that is, Ch0 to Ch7. Each nozzle includes the heater, and an ink can be discharged from the nozzle by applying the driving pulse to the heater.

The nozzle arrays for 8 ch are combined for every 2 ch, and the nozzle arrays for 2 ch are arranged to be shifted by half a pitch (1200-dpi pitch). For this reason, with this configuration, 1024 nozzles are arrayed at the 1200-dpi pitch along the conveyance direction of the printing medium.

The temperature sensors 21 and 22 are arranged at the end portions of the nozzle arrays. In this case, the temperature sensor 21 is arranged on the upstream side of the conveyance direction of the printing medium, and the temperature sensor 22 is arranged on the downstream side. Note that the temperature sensors 21 and 22 are implemented by, for example, diodes. In this embodiment, assume that an average value of the temperatures measured by the two temperature sensors is adopted as the temperature of the printhead board. Of course, temperature detecting elements other than the diodes may be used as the temperature sensors.

The relationship between the driving pulse to be applied to the heater and an ink droplet to be discharged will be described below.

Figure 5A:
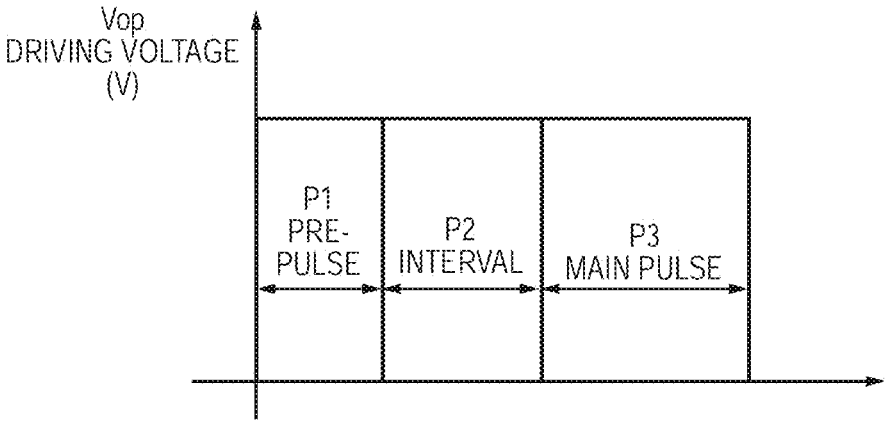
FIG. 5A is a graph showing an outline of driving pulse control (double pulses)
Figure 5B:
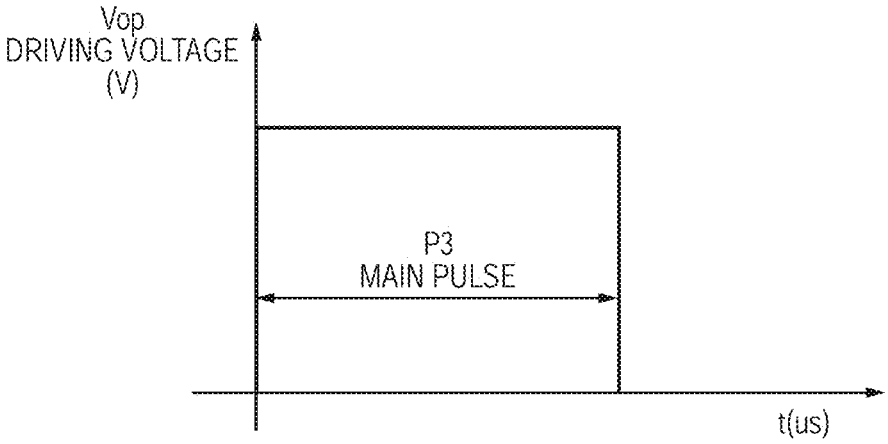
FIG. 5B is a graph showing an outline of driving pulse control (single pulse)

As the driving pulse signal HENB, double pulses (that is, one discharge operation is executed by two pulses) shown in FIG. 5A or a single pulse shown in FIG. 5B can be used. The abscissa plots a time, and the ordinate plots a voltage value to be applied to the heater.

Reference symbol P1 denotes an applying time of a pre-heat pulse; P3, an applying time of a main-heat pulse; and P2, an interval between the pre-heat pulse and main-heat pulse. The pre-heat pulse is applied to decrease viscosity by warming an ink in the vicinity of a heater surface, and the applying time P1 is defined to suppress an energy to that which does not reach bubbling.

The interval P2 is set to prevent the pre-heat pulse and main-heat pulse from interfering with each other, and to preferably obtain a temperature distribution by diffusing a thermal energy given by the pre-heat pulse in the ink.

On the other hand, the main-heat pulse is applied to cause film boiling in the ink warmed by the pre-heat pulse to discharge the ink, and the applying time P3 longer than the applying time P1 is set to give an energy enough to reach bubbling. The applying time P3 of the main-heat pulse is defined depending on the area, resistance, and film structure of the heater and the structure of an ink channel.

In this case, since the viscosity of an ink decreases with increasing temperature, a discharge amount of an ink discharged from the nozzle is proportional to the ink temperature near the heater. For this reason, the driving pulse controller 36 adjusts the applying time P1 of the pre-heat pulse and the interval P2 (an input energy and an elapsed time after that energy is input) in accordance with the detected head temperature. Thus, the ink temperature is adjusted, thus allowing to control the discharge amount.

More specifically, as the head temperature increases gradually, the ink discharge amount is decreased. For this purpose, in such case, in order to reduce a degree of decrease in ink viscosity near the heater surface, the pre-heat pulse width P1 is narrowed down. Conversely, when the head temperature decreases gradually, since the discharge amount is required to be increased by decreasing the ink viscosity, the applying time P1 of the pre-heat pulse is set to be gradually longer.

Note that when heat storage of the printhead progresses, and the applying time P1 of the pre-heat pulse becomes zero, the driving pulse is only the main pulse, as shown in FIG. 5B, and the ink discharge amount cannot be adjusted by controlling the pulse width any more.

A plurality of driving pulse tables each of which defines the aforementioned driving pulses of the plurality of types of pulse widths are stored in the memory 33. Then, the driving pulse controller 36 shown in FIG. 3 selects a driving pulse according to the head temperature to decide the driving pulse to be applied to the heater.

Figure 7A:
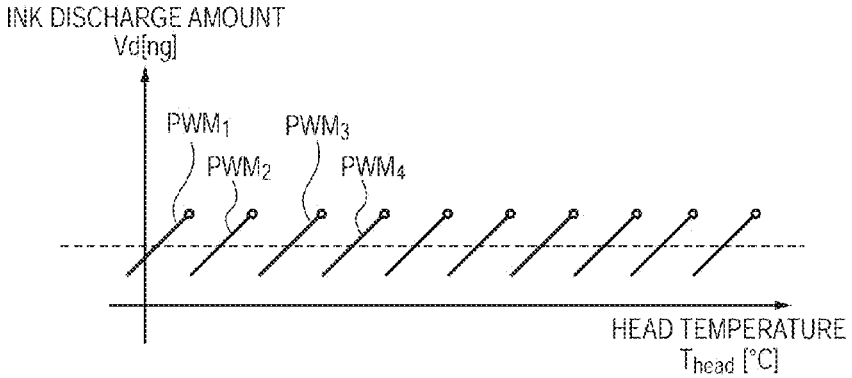
FIG. 7A is a graph showing an example of the relationship between the ink discharge amount and head temperature in level (1)
Figure 7B:
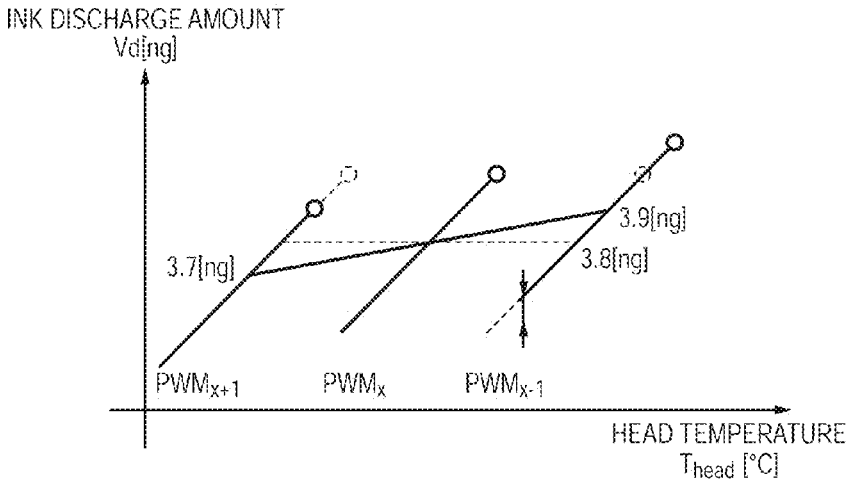
FIG. 7B is a graph showing an example of the relationship between the ink discharge amount and head temperature in level (2)
Figure 7C:
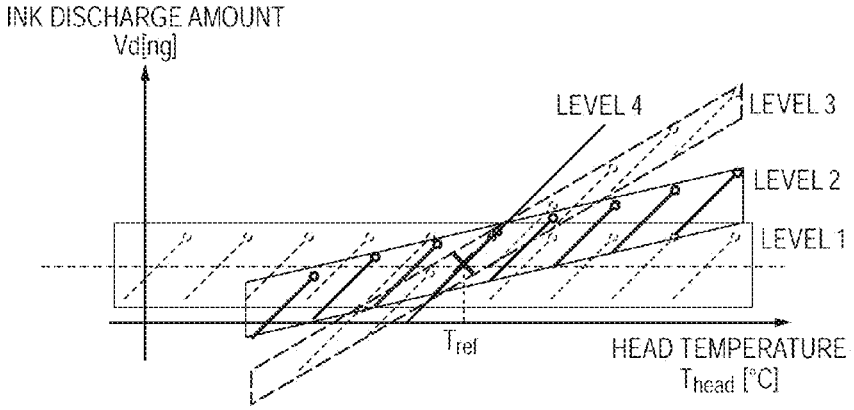
FIG. 7C is a graph showing an example of the relationships between the ink discharge amount and head temperature in levels (1) to (4)

An example of the driving pulse control according to this embodiment will be described below with reference to FIGS. 6A to 6D and FIGS. 7A to 7C. FIGS. 6A to 6D include tables showing examples of pulse widths of respective levels in driving pulse tables and target ink discharge amounts corresponding to the temperatures of the printhead. FIGS. 7A to 7C are graphs showing the relationship between the driving pulses and discharge amounts of an ink to be discharged at that time.

As shown in FIG. 6A to 6D, the driving pulse table of each level includes a plurality of driving pulses in correspondence with used temperature ranges. These driving pulses are set so that an ink of a target discharge amount is discharged at the center temperature of each used temperature range.

A plurality of driving pulses held in the driving pulse table of level (1) shown in FIG. 6A are set to maintain a constant target discharge amount (3.8 ng) at the center temperatures of the respective used temperature ranges. FIG. 7A shows the head temperatures and actual discharge amounts corresponding to these temperatures when printing is executed using the plurality of driving pulses held in the table of level (1). That is, in level (1), even when the head temperature increases, the ink discharge amount is controlled to fall within a given range. In this case, the driving pulses are selected to shorten the applying time P1 of the pre-heat pulse.

A plurality of driving pulses held in the driving pulse table of level (2) shown in FIG. 6B are set so that a target ink discharge amount is increased by 0.05 (ng/° C.) at the center temperatures of the respective used temperature ranges. That is, in level (2), as can also be seen from FIG. 7B, as the head temperature increases, the driving pulses are selected to gradually increase the target ink discharge amount.

More specifically, when the head temperature increases, and the driving pulse is switched from $PWM_{X+1}$ to $PWM_X$, the target ink discharge amount is changed from 3.75 ng to 3.8 ng. On the other hand, when the driving pulse is switched from $PWM_X$ to $PWM_{X-1}$, the target discharge amount is changed from 3.8 ng to 3.85 ng.

A plurality of driving pulses held in the driving pulse table of level (3) shown in FIG. 6C are set so that a target ink discharge amount is increased by 0.10 (ng/° C.) at the center temperatures of the respective used temperature ranges. That is, in level (3), as the head temperature increases, the driving pulses are set to further gradually increase the target ink discharge amount more than the case of level (2).

A plurality of driving pulses held in the driving pulse table of level (4) shown in FIG. 6D are set so that a target ink discharge amount is increased by 0.20 (ng/° C.) at the center temperatures of the respective used temperature ranges. In this case, the ink discharge amount to be increased upon increasing of the head temperature is nearly constant. In other words, in level (4), the driving pulse is left unchanged. FIG. 7C shows an outline by plotting these levels (1) to (4).

In this embodiment, the level of the driving pulse table is selected according to a portion used in printing of an element array of the plurality of heaters (heat generation elements). In this embodiment, the driving pulse table of a corresponding level of levels (1) to (4) shown in FIGS. 6A to 6D is selected according to the number of heaters (heat generation elements) included in the portion to be used in printing of the element array, that is, the number of nozzles. As shown in FIG. 8A, when the number of used nozzles falls within a range from 0 to 256 nozzles, the driving pulse table of level (4) is selected. When the number of used nozzles falls within a range from 257 to 512 nozzles, the driving pulse table of level (3) is selected. When the number of used nozzles falls within a range from 513 to 768 nozzles, the driving pulse table of level (2) is selected. When the number of used nozzles falls within a range from 769 to 1024 nozzles, the driving pulse table of level (1) is selected. That is, the driving pulse table is selected to increase the target ink discharge amount as the number of used nozzles becomes smaller and as the head temperature increases.

Figure 24A:
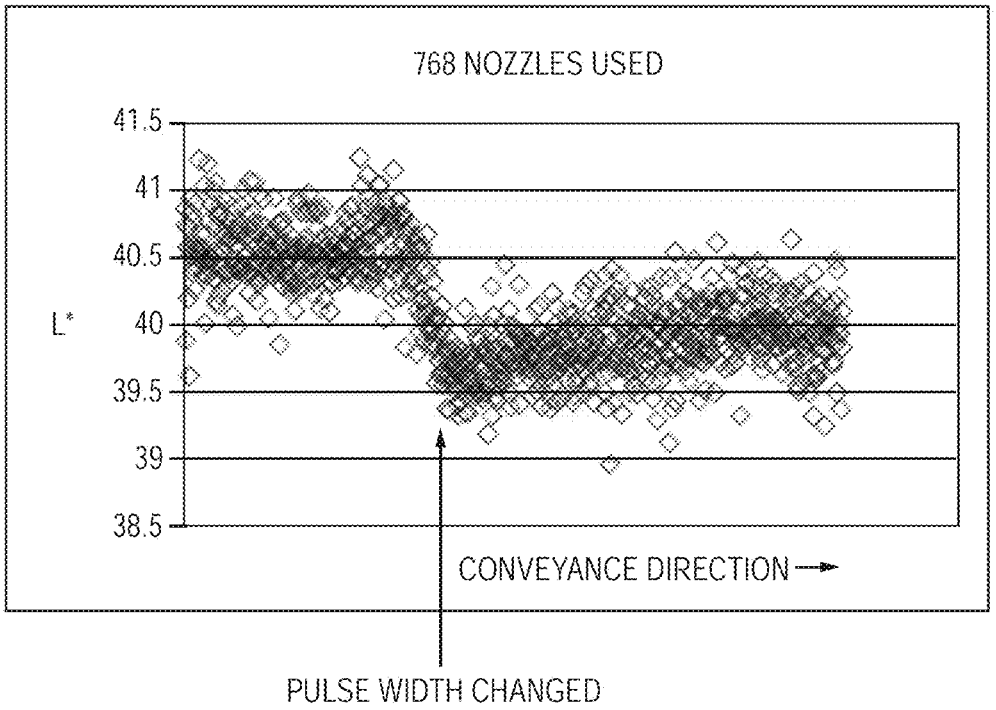
FIG. 24A is a graph showing a change in lightness when a printing operation is executed using 768 nozzles.
Figure 24B:
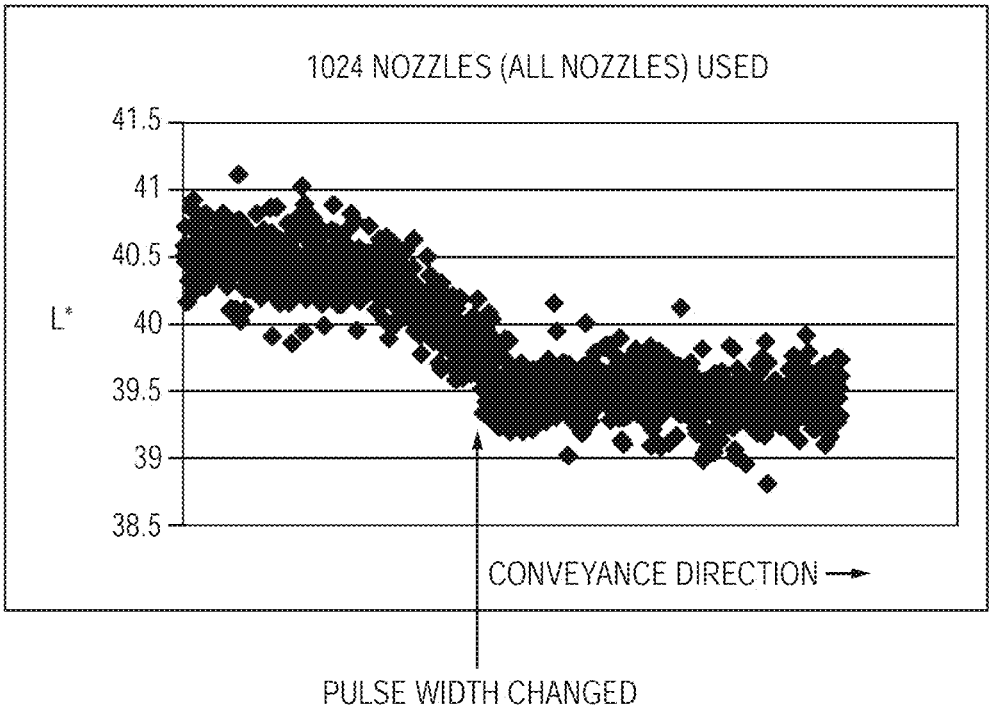
FIG. 24B is a graph showing a change in lightness when a printing operation is executed using 1024 nozzles.

As described above, as the number of used nozzles is decreased, since a lightness difference caused by a change in ink discharge amount occurs in a narrow area, as shown in FIG. 24A, it is readily recognized as uneven density. Hence, in this embodiment, as shown in FIG. 8A, the driving pulse table is selected to increase the target ink discharge amount when the number of used nozzles is decreased. Thus, even when the head temperature increases and the driving pulse is changed, a change in ink discharge amount before and after a change of the driving pulse can be eliminated. For this reason, uneven density can be reduced while suppressing the lightness difference.

In this embodiment, assume that "fine", "normal", and "quick" are provided as print modes indicating print qualities in the printing apparatus 1, as shown in FIG. 8B. The number of used nozzles changes for each print mode, and the number of printing passes also changes accordingly.

An example of the processing sequence of the printing apparatus 1 will be described below with reference to FIG. 9A. In this case, the driving pulse control will be explained.

Figure 10:
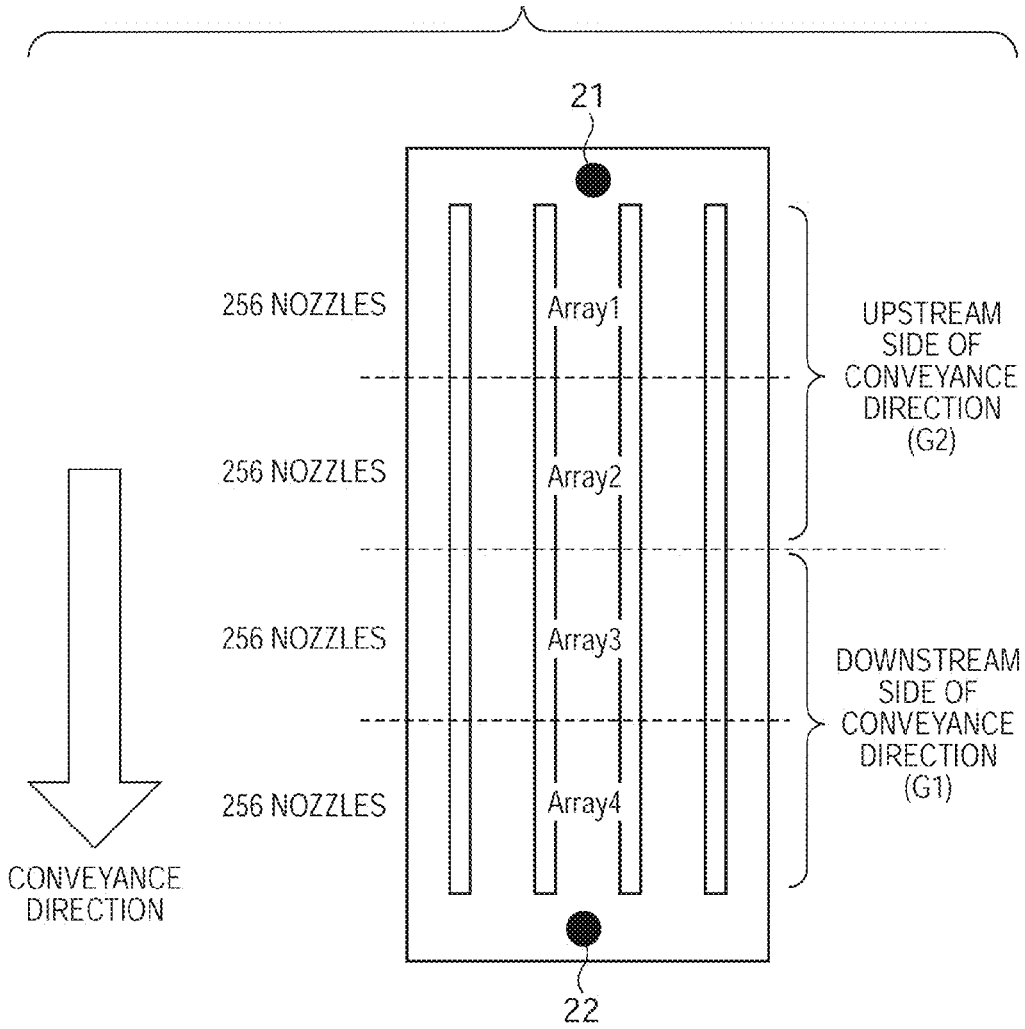
FIG. 10 is a view showing an outline of used nozzle positions.

The printing apparatus 1 controls the ASIC 31 to acquire the number of used nozzles (step S101). The number of used nozzles is acquired based on a specifying result of the used nozzle specifying unit 37. As described above, when the "fine" mode is selected, "256" is acquired as the number of used nozzles. At this time, as shown in FIG. 10, one of four nozzle groups (Array1 to Array4) in the nozzle arrays is selected.

Next, the printing apparatus 1 controls the head driving signal control unit 34 to decide a level according to the number of used nozzles (step S102). In the "normal" mode in which the number of used nozzles is "768", the driving pulse table of level (2) is selected, as can be seen from FIG. 8A. In the "fine" mode in which the number of used nozzles is "256", the driving pulse table of level (4) is selected, as can be seen from FIG. 8A.

That is, in the print mode in which the number of used nozzles is small, the driving pulse table in which a ratio of an increase in target ink discharge amount with respect to an increase in head temperature is large is selected compared to the print mode in which the number of used nozzles is large. For example, when the number of used nozzles is a first number, a first driving pulse table is selected. When the number of used nozzles is a second number smaller than the first number, a second driving pulse table is selected. In this case, in the second driving pulse table, the ratio of an increase in target ink discharge amount according to an increase in temperature of the printhead is larger than the first driving pulse table.

After the level is decided in this way, the printing apparatus 1 controls the head driving signal control unit 34 to decide a driving pulse from the selected driving pulse table (step S103).

The driving pulse deciding processing in step S103 will be described below with reference to FIG. 9B.

When this processing starts, the printing apparatus 1 controls the head driving signal control unit 34 to acquire a head temperature (and environmental temperature) (step S201). More specifically, two pieces of temperature information, that is, the head temperature acquired by the temperature sensors 21 and 22 of the printhead 3 and the environmental temperature in a periphery of the printing apparatus, which is acquired by a thermistor (not shown) mounted on the main board 30 of the printing apparatus 1, are acquired.

Figure 9A:
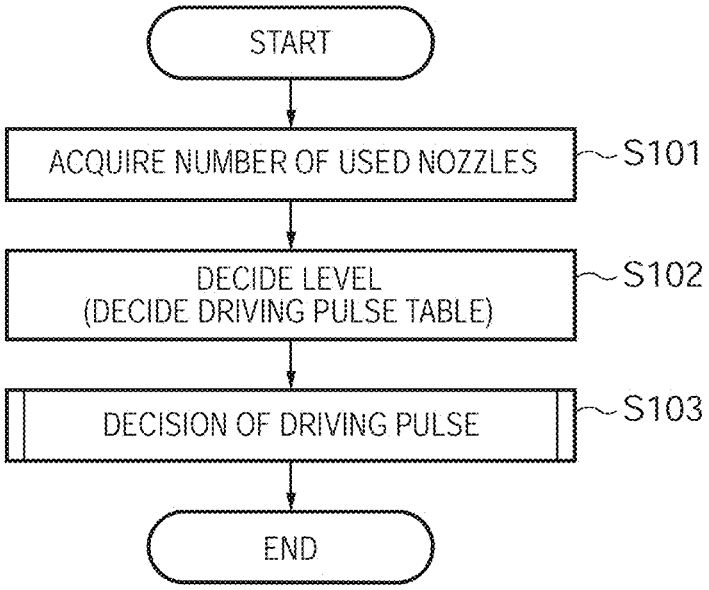
FIG. 9A is a flowchart showing an example of the processing sequence of the printing apparatus 1 according to the first embodiment.
Figure 9B:
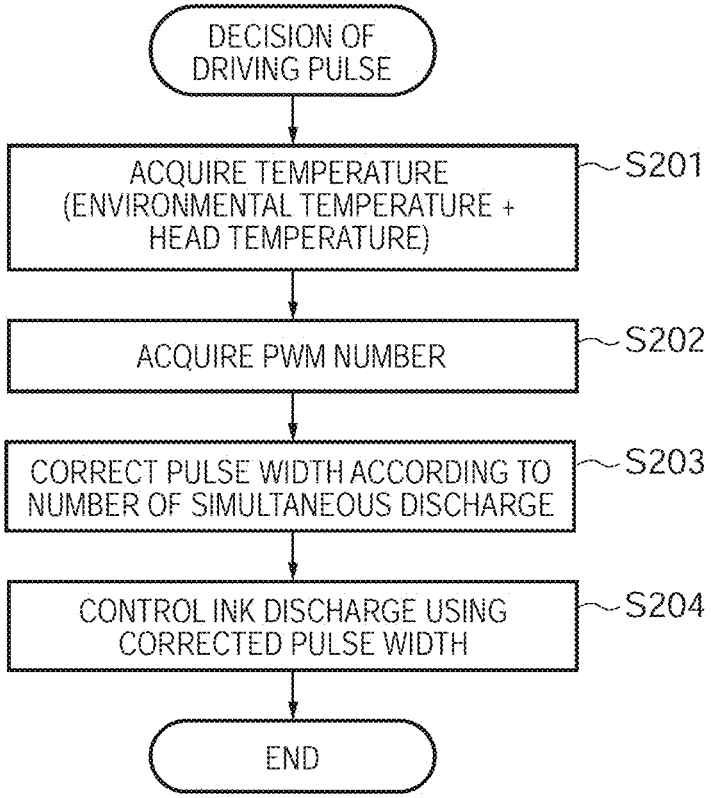
FIG. 9B is a flowchart showing an example of driving pulse deciding processing according to the first embodiment.

After the environmental temperature and head temperature are acquired, the printing apparatus 1 controls the head driving signal control unit 34 to acquire a PWM number from the driving pulse table selected in the processing of step S102 in FIG. 9A based on the acquired environmental temperature and head temperature (step S202). For example, taking a driving pulse table shown in FIG. 11 as an example, when an environmental temperature Tenv is 25° C., and a head temperature Thead is 28° C., ΔT (Thead−Tenv)=3° C., and "PWM12" is selected. That is, a driving pulse is selected according to the head temperature, and when the head temperature increases, a driving pulse having a different pulse width is selected.

After the PWM number is selected, the printing apparatus 1 controls the head driving signal control unit 34 to correct the driving pulse (pre-heat pulse and main-heat pulse) based on the number of simultaneous discharges (step S203). Note that this processing need not always be executed.

In this case, such correction based on the number of simultaneous discharges is executed since a current value flowing through the heater changes due to the influence of a voltage drop and the ink discharge amount is decreased when the number of heaters to be driven simultaneously increases. In this processing, the driving pulse controller 36 can correct a pulse width according to a correction table shown in FIG. 12, so that the ink discharge amount becomes constant.

In this table, the number of simultaneous discharges is classified into 16 levels, and a pulse width is corrected according to the number of simultaneous discharges. In this correction processing, the pulse width is corrected based on the number of simultaneous discharges to compensate for a power loss at that time. In the correction table shown in FIG. 12, a decrease in discharge energy due to a power loss caused by an increase in the number of simultaneous discharges is compensated for by increasing the main-heat pulse width.

After the final driving pulse is decided in this way, the printing apparatus 1 controls the head driving signal control unit 34 to execute the ink discharge control from respective nozzles by driving the heaters using the driving pulse (step S204).

As described above, according to the first embodiment, when the number of used nozzles is small, an increase amount of the target ink discharge amount is increased with increasing head temperature. Thus, even when the head temperature increases and the driving pulse is changed, since a change in ink discharge amount caused before and after the change of the driving pulse can be eliminated, a change in lightness that causes uneven density can be suppressed from abruptly occurring.

Note that the first embodiment has explained the case in which the number of used nozzles is changed according to the print mode indicating a print quality. However, printing operations are executed in various situations while changing the number of used nozzles independently of such print quality. For example, the print mode may be changed when conveyance accuracy lowers due to eccentricity of a conveyance roller used to convey the printing medium. In this case, in the printing apparatus 1, the printing operation is executed while decreasing the number of used nozzles, so as to eliminate uneven density of a print image caused by the eccentricity of the conveyance roller.

Figure 13:
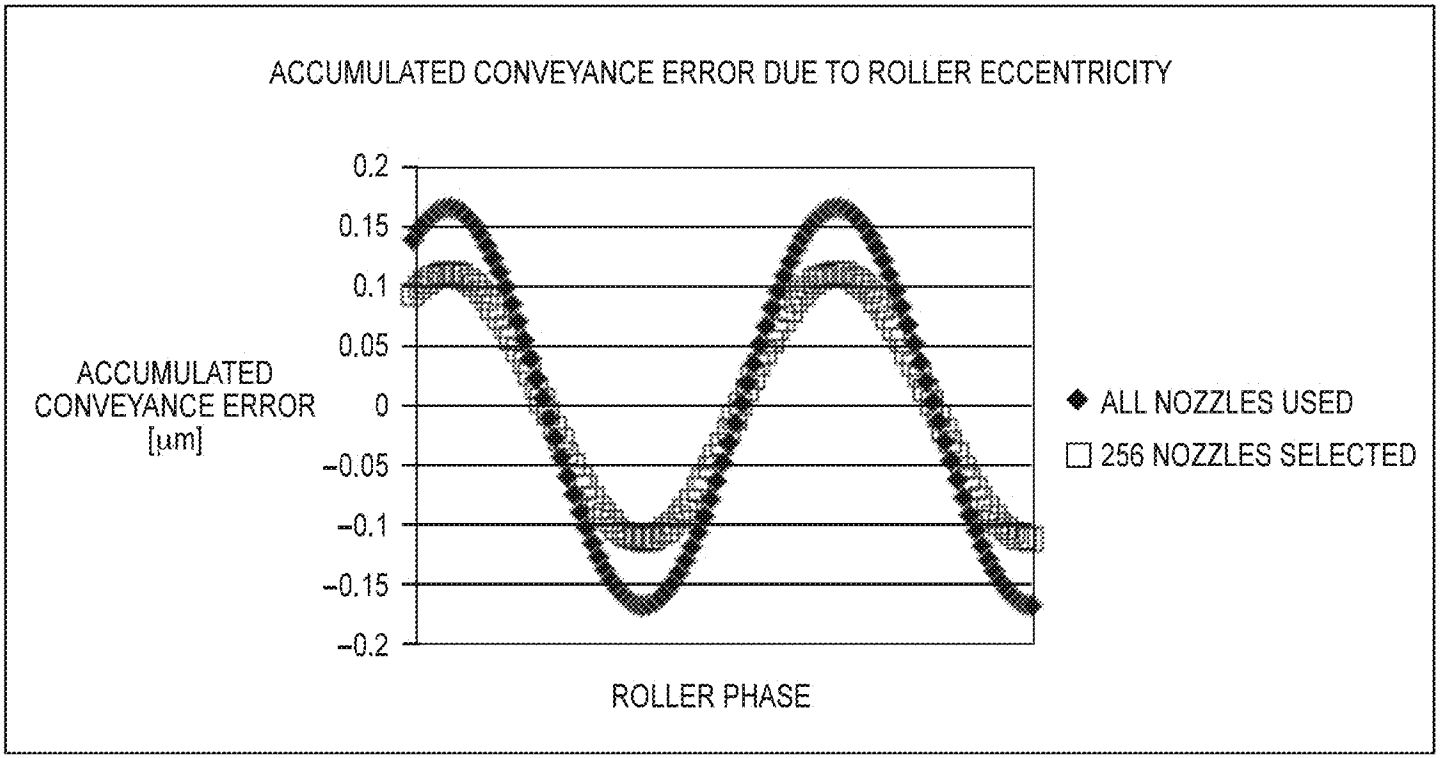
FIG. 13 is a graph showing an outline of an accumulated conveyance error caused by an eccentricity amount of a conveyance roller.

An accumulated conveyance error accumulated due to the eccentricity amount of the conveyance roller before an image printing operation ends can be reduced by decreasing the number of nozzles, as shown in FIG. 13. Since the number of used nozzles and printing speed have a trade-off relationship, the printing speed decreases with increasing the number of used nozzles. On the other hand, when the number of used nozzles is increased, the accumulated conveyance error can be more suppressed.

Second Embodiment

The second embodiment will be described below. The second embodiment will explain a case in which the ink discharge amount control is executed using, as the printhead temperature, the temperature measured by only the temperature sensor 21 located on the upstream side of the conveyance direction of the two temperature sensors of the printhead shown in FIG. 10. Since other arrangements and the driving pulse tables of respective levels are the same as those in the first embodiment, a description thereof will not be repeated.

In this case, the temperature sensor 21 is arranged in the vicinity of the head connection element 43, and a signal line of the temperature sensor 22 has to be wired while bypassing the nozzle arrays. For this reason, noise is readily superimposed on a signal from the temperature sensor 22.

Hence, in the second embodiment, only the temperature sensor 21 of the two temperature sensors 21 and 22 is used to acquire the head temperature regardless of the influence of noise. Note that a description of this embodiment will be focused on the driving pulse control when only the temperature sensor of one side is used. This driving pulse control is executed according to the number of used nozzles and used nozzle position, as described above.

FIG. 14 is a table showing the numbers of used nozzles, used nozzle positions (Array numbers in FIG. 10), and the numbers of passes depending on printing media and print modes according to the second embodiment.

As can be seen from FIG. 14, printing operations for sheets A and B use the same numbers of nozzles and the same numbers of passes, but used nozzle positions are different. More specifically, as nozzles used in the "fine" and "normal" modes for sheet A, those on the downstream side (G1) of the conveyance direction, that is, those having larger distances from the temperature sensor 21, are used. As nozzles used in the "fine" and "normal" modes for sheet B, those on the upstream side (G2) of the conveyance direction, that is, those having smaller distances from the temperature sensor 21, are used.

FIG. 15 is a table showing the numbers of used nozzles, and levels of driving pulse tables to be used according to distances of nozzles to be used from the temperature sensor.

In printing operations for sheet B, the same levels of the driving pulse tables used in the first embodiment are used. This is because the barycentric position of the plurality of nozzles to be used is located on the upstream side (G2) of the conveyance direction and is close to the temperature sensor 21, and a value acquired by the temperature sensor has high reliability.

On the other hand, in printing operations for sheet A in the "fine" and "normal" modes, the barycentric position of the plurality of nozzles to be used is distant from the temperature sensor. That is, since the barycentric position is located on the downstream side (G1), a deviation between a temperature near the used nozzle position and the value acquired by the temperature sensor may occur. For this reason, in this case, the driving pulse table which hardly causes uneven density when the head temperature increases and the driving pulse is changed is selected.

Figure 16:
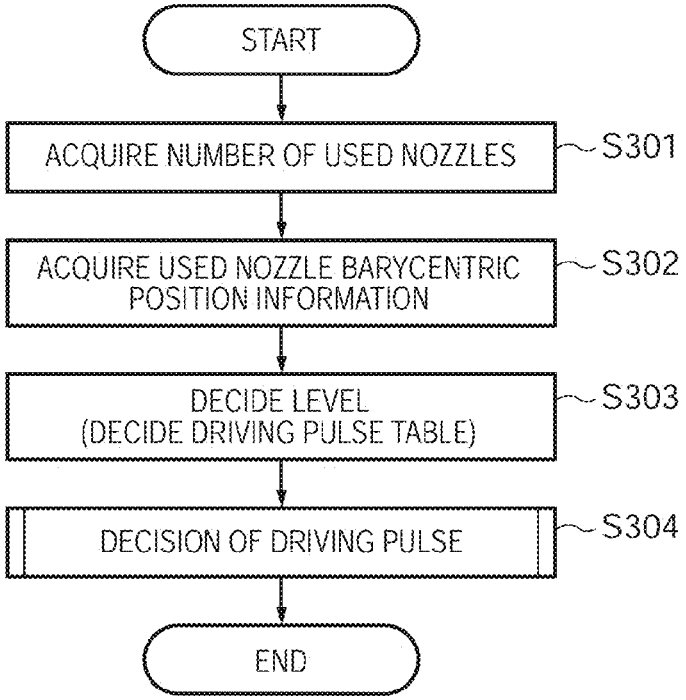
FIG. 16 is a flowchart showing an example of the processing sequence of the printing apparatus 1 according to the second embodiment.

An example of the processing sequence of the printing apparatus 1 according to the second embodiment will be described below with reference to FIG. 16. In this case, the driving pulse control will be explained.

The printing apparatus 1 controls the ASIC 31 to acquire the number of used nozzles (step S301), and to acquire information as to whether the barycentric position of used nozzles is located on the downstream side (G1) of the conveyance direction distant from the temperature sensor or the upstream side (G2) of the conveyance direction close to the temperature sensor (step S302). For example, in the "normal" mode for sheet A, a print operation is executed using 768 nozzles in Array2, Array3, and Array4 in FIG. 10 as the used nozzle positions based on the table shown in FIG. 14. Also, the barycentric position of used nozzles is located on the downstream side (G1) of the conveyance direction.

Subsequently, the printing apparatus 1 controls the head driving signal control unit 34 to select the driving pulse table based on the number of used nozzles and the barycentric position of used nozzles with reference to the table shown in FIG. 14 (step S303). At this time, the driving pulse table in which as the number of used nozzles becomes smaller, the target ink discharge amount increases with increasing head temperature is selected. Or the driving pulse table in which an increase amount of the target ink discharge amount is larger as the used nozzle position is farther from the temperature sensor is selected.

That is, in case of sheet B, when a printing operation is executed using 768 nozzles, the driving pulse table of level (2) is selected. By contrast, in case of sheet A, when a printing operation is executed using 768 nozzles, the driving pulse table of level (3) is selected.

After that, the printing apparatus 1 controls the head driving signal control unit 34 to execute the discharge control of inks from respective nozzles by deciding a driving pulse using the selected driving pulse table, and driving the heaters as in the first embodiment (step S304).

As described above, according to the second embodiment, even when the temperature sensor measures a head temperature of a local area, uneven density due to a change in lightness caused when the driving pulse is changed can be eliminated.

Third Embodiment

The third embodiment will be described below. The third embodiment will explain a case in which the number of used nozzles is changed in the middle of a printing operation for one printing medium. Note that a case will be exemplified wherein a driving pulse is decided using the two temperature sensors 21 and 22 shown in FIG. 10.

Figure 17:
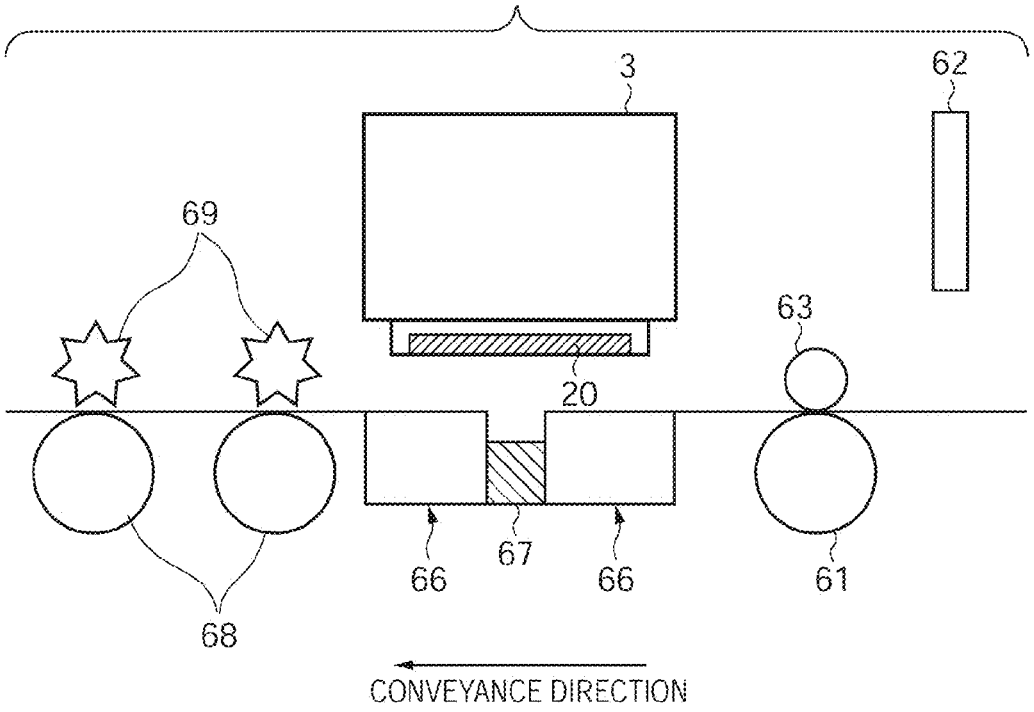
FIG. 17 is a view showing an outline of a conveyance mechanism.

An outline of a conveyance mechanism of the printing apparatus 1 will be described first with reference to FIG. 17. FIG. 17 is a side view of the conveyance mechanism of a printing medium. The printing medium is conveyed from the right side (upstream side of the conveyance direction) toward the left side (downstream side of the conveyance direction) in FIG. 17.

A conveyance roller 61 is configured by coating ceramic micro-particles on the surface of a metal shaft, and is attached to a chassis while its metal parts of the two sides of the shaft are received by bearings (not shown). A roller tension spring (not shown) is provided to the conveyance roller 61, and biases the conveyance roller 61 to give a proper load upon rotation of the conveyance roller 61, thus allowing stable conveyance.

A driven pinch roller 63 is provided to the conveyance roller 61. The pinch roller 63 is set on the conveyance roller 61 while being biased by a pinch roller spring (not shown), thus generating a conveyance force of the printing medium. A sheet-end sensor 62 detects a leading edge and trailing edge of the printing medium.

The printhead 3 including the heater boards 20 is arranged on the downstream side of the conveyance roller 61 along the conveyance direction of the printing medium. A marginless printing platen absorbent material 67 is arranged immediately below 256 nozzles (1200-dpi pitch) located at a central portion of the respective nozzle arrays on the heater boards 20. Ribs 66 serving as conveyance reference surfaces are arranged on the two sides of the platen absorbent material 67. A plurality of (two in this case) discharge rollers 68 and spur rollers 69 are arranged in a sheet discharge unit.

Printing areas of the printing medium, the numbers of used nozzles, and nozzle positions will be described below with reference to FIG. 18.

The printing medium is separated into a plurality of areas A to E according to information of the numbers of used nozzles and used nozzle positions. A case will be described below wherein "quick" shown in FIG. 8B is selected as the print mode, and a printing operation is executed in eight passes using 1024 nozzles.

The printing operation is executed for the area C on the printing medium in a stable conveyance state in which the two edges (along the conveyance direction) of the printing medium are nipped by the conveyance roller 61 and discharge rollers 68. For this reason, the printing operation is executed for the area C using 1024 nozzles (FIG. 19).

Since the areas A and E are end portions of a marginless printing operation, the printing operation is executed beyond the leading and trailing edges of the printing medium. The printing operation is executed on two end portions of the printing medium, that is, the areas A and E using a total of 256 nozzles, that is, 384th to 639th nozzles counted from the upstream side of the conveyance direction (FIG. 19).

Figure 18:
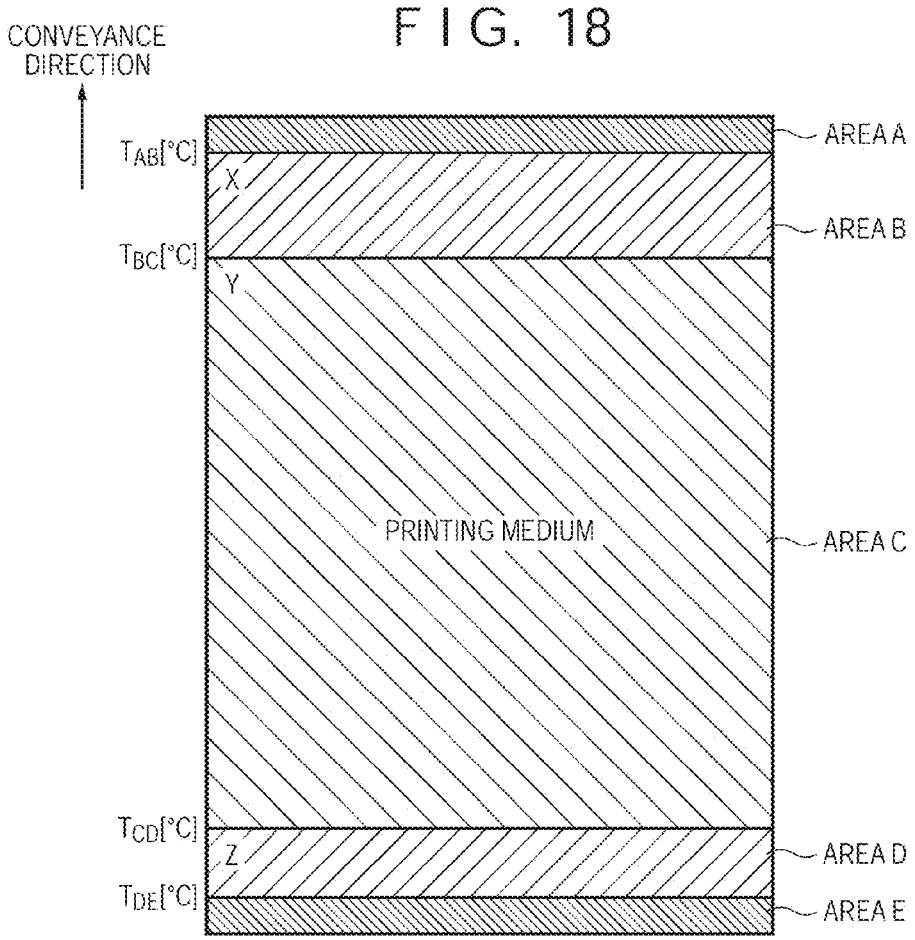
FIG. 18 is a view for explaining areas classified according to positions of a printing medium.

At the time of the printing operation on the area B shown in FIG. 18, the printing operation is executed while changing the number of used nozzles and used nozzle positions, so as to prepare for entry of the leading edge portion of the printing medium into a nip of the spur rollers 69. Also, at the time of the printing operation on the area D shown in FIG. 18, the printing operation is executed while changing the number of used nozzles and used nozzle positions, so as to prepare for the release timing of the trailing edge of the printing medium from a nip of the conveyance roller 61.

Figure 19:
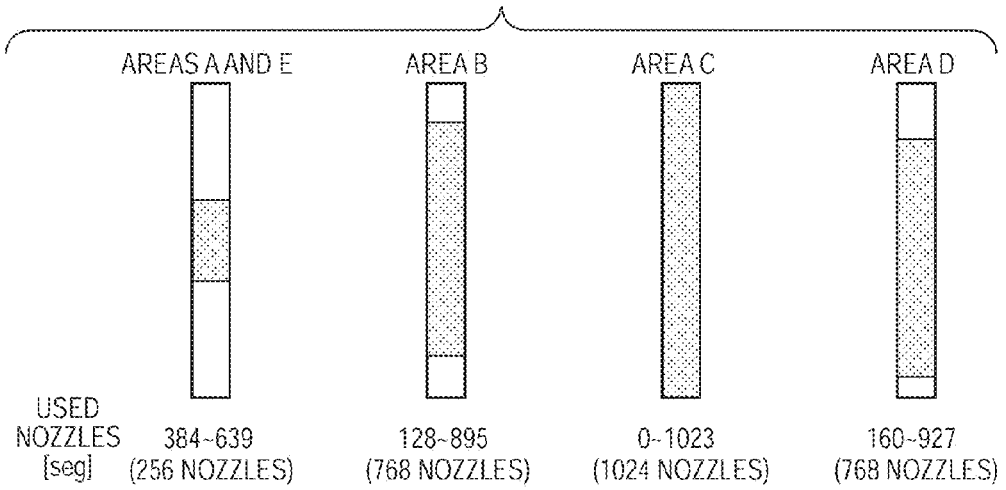
FIG. 19 is a view showing nozzles used in printing operations for the respective areas on the printing medium.

Upon printing on the area B, a total of 768 nozzles, that is, 128th to 895th nozzles counted from the upstream side of the conveyance direction are used in the printing operation (FIG. 19). Also, upon printing on the area D, a total of 768 nozzles, that is, 160th to 927th nozzles counted from the upstream side of the conveyance direction are used in the printing operation (FIG. 19).

That is, when the two temperature sensors are used as in the first embodiment, the driving pulse table of level (4) is used for the printing operation on the areas A and E using 256 nozzles (see FIG. 8A).

The driving pulse table of level (2) is used for the printing operation on the areas B and D using 768 nozzles, and the driving pulse table of level (1) is used for the printing operation on the area C using 1024 nozzles (see FIG. 8A).

As described above, according to the third embodiment, the driving pulse tables to be referred to are switched during the printing operation across the areas A to E of the printing medium. For this reason, if only one type of a pulse width of a driving pulse corresponds to a given temperature, when the printing areas are changed and the driving pulse tables are switched, the pulse width of the driving pulse changes largely, thus causing an abrupt density change of an image. More specifically, in case of the driving pulse tables shown in FIG. 8A, a driving pulse corresponding to a head temperature=34° C. in level (2) may be changed to that corresponding to a head temperature=34° C. in level (1). At this time, since the driving pulse which targets at an ink discharge amount=4.00 ng is changed to that which targets at 3.8 ng, an abrupt density change of an image may occur.

Hence, in the third embodiment, the ink discharge amount is controlled so that the ink discharge amount of a driving pulse before the driving pulse table is changed matches that of a driving pulse after the driving pulse table is changed. Thus, an abrupt density change of an image can be suppressed.

Figure 20:
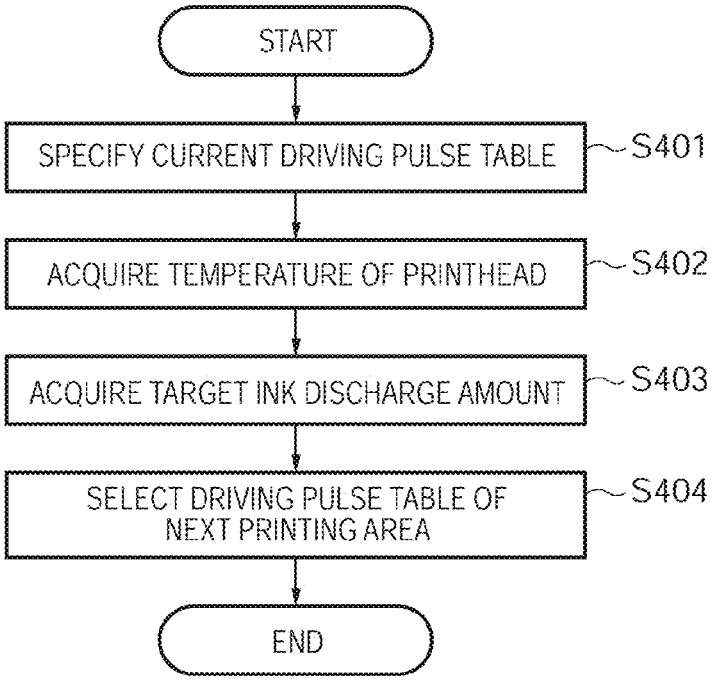
FIG. 20 is a flowchart showing an example of the processing sequence of the printing apparatus 1 according to the third embodiment.

An example of the processing sequence of the printing apparatus 1 according to the third embodiment will be described below with reference to FIG. 20. In this case, the driving pulse control on boundary portions of the aforementioned respective areas on the printing medium will be described.

The printing apparatus 1 controls the head driving signal control unit 34 to specify the current driving pulse table (step S401). Next, the printing apparatus 1 acquires a head temperature using the temperature sensors 21 and 22 (step S402). Then, the printing apparatus 1 specifies a driving pulse corresponding to the head temperature acquired in the processing of step S402 from the driving pulse table specified in the processing of step S401, and reads out a target ink discharge amount at that time (step S403).

After the target ink discharge amount is acquired, the printing apparatus 1 controls the head driving signal control unit 34 to select the driving pulse table having the same target discharge amount from the plurality of driving pulse tables corresponding to the level of the next printing area based on the target ink discharge amount and the head temperature acquired in the processing of step S402 (step S404).

The driving pulse tables to be selected upon changing of the printing areas will be described below taking a practical example.

When the area A is switched to the area B, the driving pulse table of level (4) which raises the target ink discharge amount by 0.2 ng every time the head temperature increases by 1° C. is shifted to the driving pulse table of level (2) which raises the target ink discharge amount by 0.05 ng every time the head temperature increases by 1° C. Let $T_{AB}$ be a head temperature at the time of printing of a terminal end (point X) of the area A (a start end of the area B). Assuming that the target discharge amount of the driving pulse table of level (4) at the head temperature at that time is 3.8 ng, the driving pulse table including the target discharge amount=3.8 ng at the head temperature $T_{AB}$ is selected from the plurality of driving pulse tables of level (2).

Figure 21:
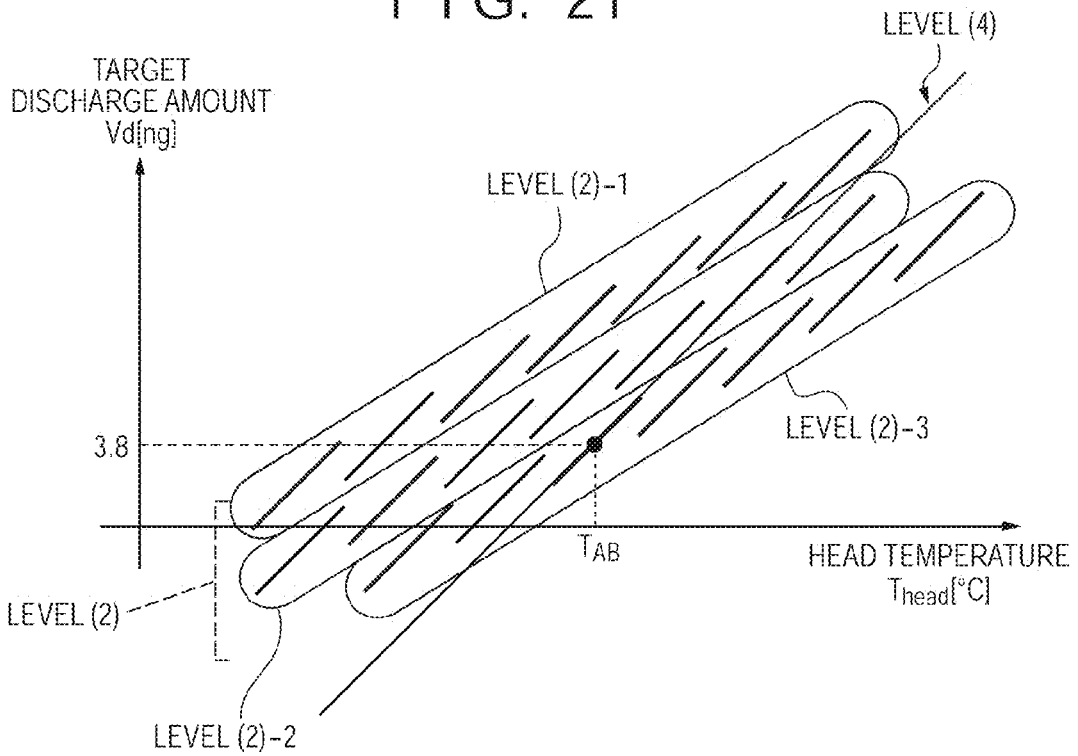
FIG. 21 is a graph showing an outline of the processing according to the third embodiment.

Switching from the area A to the area B will be described below with reference to FIG. 21. FIG. 21 shows an outline upon switching from the driving pulse table of level (4) to that of level (2) at the point X in FIG. 18.

The head temperature at the point X is $T_{AB}$, and the target discharge amount of a driving pulse width selected according to the driving pulse table of level (4) at that head temperature is 3.8 ng. Then, based on this head temperature and target discharge amount, a table of level (2)-3 having the same target discharge amount at the head temperature $T_{AB}$ is selected from the plurality of driving pulse tables of level (2).

Furthermore, upon switching from the area B to the area C, the driving pulse table of level (3) which raises the target discharge amount by 0.1 ng every time the head temperature increases by 1° C. is shifted to the driving pulse table of level (1) which leaves the target discharge amount unchanged even when the head temperature increases.

Let $T_{BC}$ be a head temperature at the time of printing of a terminal end (point Y) of the area B (a start end of the area C) shown in FIG. 18. Assuming that the target ink discharge amount at that head temperature is 4.0 ng, a driving pulse table including the target discharge amount=4.0 ng at the head temperature $T_{BC}$ is selected from the plurality of driving pulse tables of level (1).

Figure 22:
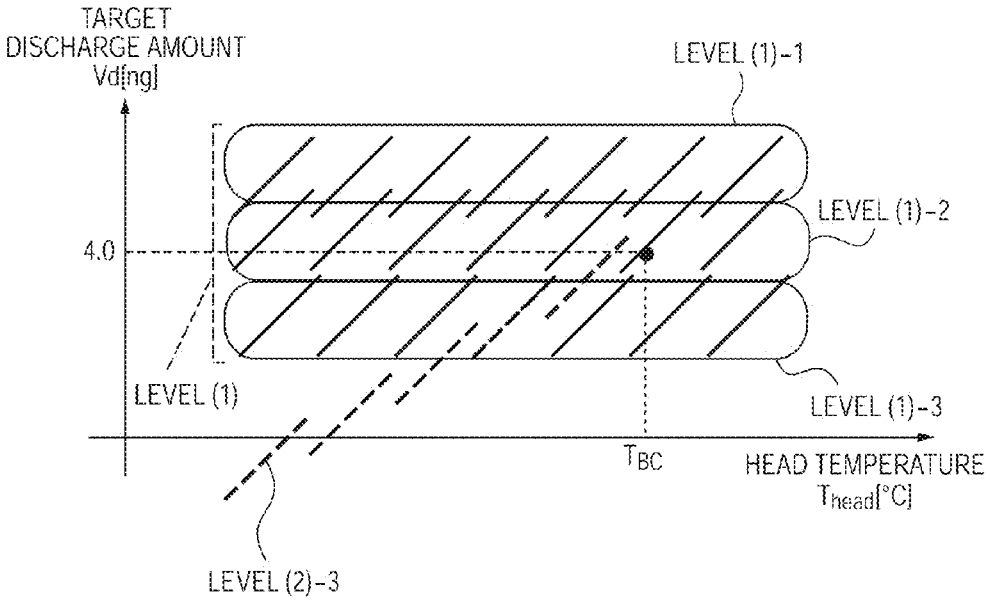
FIG. 22 is a graph showing an outline of the processing according to the third embodiment.

Switching from the area B to the area C will be described below with reference to FIG. 22. FIG. 22 shows an outline upon switching from the driving pulse table of level (2)-3 to that of level (1) at the point Y of FIG. 18.

The head temperature at the point Y is $T_{BC}$, and the target discharge amount of a driving pulse width selected according to the driving pulse table of level (2)-3 at that head temperature is 4.0 ng. Then, based on this head temperature $T_{BC}$ and target discharge amount, a table of level (1)-2 having the same target discharge amount=4.0 ng at the head temperature $T_{BC}$ is selected from the plurality of driving pulse tables of level (1).

Furthermore, upon switching from the area C to the area D, the driving pulse table of level (1) which leaves the target discharge amount unchanged even when the head temperature increases is shifted to the driving pulse table of level (2) which raises the target discharge amount by 0.05 ng every time the head temperature increases by 1° C. Let $T_{CD}$ be a head temperature at the time of printing of a terminal end (point Z) of the area C (a start end of the area D) shown in FIG. 18. Assuming that the target ink discharge amount at that head temperature is 4.0 ng, a driving pulse table including the target discharge amount=4.0 ng at the head temperature $T_{CD}$ is selected from the plurality of driving pulse tables of level (2).

Figure 23:
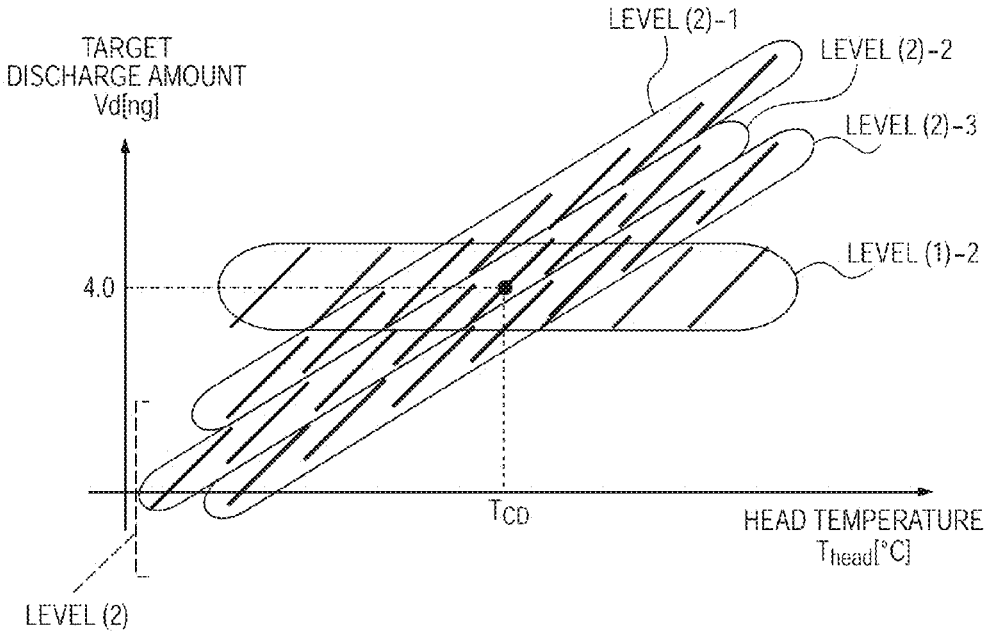
FIG. 23 is a graph showing an outline of the processing according to the third embodiment.

Switching from the area C to the area D will be described below with reference to FIG. 23. FIG. 23 shows an outline upon switching from the driving pulse table of level (1)-2 to that of level (2) at the point Z of FIG. 18.

The head temperature at the point Z is $T_{CD}$, and the target discharge amount of a driving pulse width selected according to the driving pulse table of level (1)-2 at that head temperature is 4.0 ng. Then, based on this head temperature $T_{CD}$ and target discharge amount, a driving pulse table of level (2)-2 having the same target ink discharge amount=4.0 ng at the head temperature $T_{CD}$ is selected from the plurality of driving pulse tables of level (2).

Furthermore, the same applies to switching from the area D to the area E, and the driving pulse table is switched to that of level (4) having the same discharge amount as the target discharge amount of level (2)-2 at a head temperature $T_{DE}$.

That is, when the areas are switched and the driving pulse tables are changed, the driving pulse table after the change is selected so that energy amounts of driving pulses before and after the change are practically equal to each other.

In this embodiment, upon switching of the driving pulse tables between the areas, the driving pulse table which practically matches settings of a head temperature and ink discharge amount immediately before switching is selected. However, a driving pulse table which matches the ink discharge amount setting is often not available. In such case, for example, a driving pulse table having the closest ink discharge amount setting at the head temperature may be selected.

As described above, according to the third embodiment, in addition to selection of the level according to the number of used nozzles, the driving pulse table is selected to match energy amounts upon switching of the levels of the driving pulse tables during the printing operation. In this way, a lightness change caused by an ink discharge amount difference upon switching of the driving pulse tables can be suppressed.

When the number of used nozzles is small, the target ink discharge amount is increased with increasing head temperature. Thus, even when the number of used nozzles is small upon changing a driving pulse while the temperature of the heater board increases, a lightness change that causes uneven density can be suppressed from abruptly occurring.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

For example, the aforementioned third embodiment has explained the case using the two temperature sensors. However, the same processing can be executed even when one temperature sensor is used as in the second embodiment. That is, in the arrangement of the third embodiment as well, different levels may be selected according to the barycentric positions of used nozzles.

This application claims the benefit of Japanese Patent Application No. 2011-251022, filed Nov. 16, 2011, which is hereby incorporated by reference herein in its entirety.

What is claimed is:

1. An inkjet printing apparatus comprising:

a printhead including a temperature sensor and an element array formed by arraying a plurality of heat generation elements, each of which generates thermal energy required to discharge ink in response to application of a driving pulse, wherein the printhead is configured such that a portion of the element array used for printing is changeable;

an obtaining unit configured to obtain information relating to the portion of the element array to be used for printing; and a determination unit configured to determine a driving pulse, to be applied to the respective heat generation elements, for discharging the ink for printing, according to a temperature of the printhead sensed by the temperature sensor and according to the portion of the element array used for printing determined based on the information obtained by the obtaining unit.

2. The apparatus according to claim 1, further comprising a storage unit configured to store a plurality of driving pulse tables required to define a plurality of driving pulses, wherein the determination unit selects one driving pulse table from the plurality of driving pulse tables based on the information obtained by the obtaining unit, and the determination unit determines the driving pulse to be applied to the respective heat generation elements from the selected driving pulse table based on the temperature of the printhead sensed by the temperature sensor.

3. The apparatus according to claim 2, wherein the plurality of driving pulses in a first driving pulse table selected when the number of heat generation elements included in the portion is a first number is defined so that a ratio of an increase in target ink discharge amount according to an increase in temperature of the printhead is higher than that for the plurality of driving pulses in a second driving pulse table selected when the number of heat generation elements included in the portion is a second number greater than the first number.

4. The apparatus according to claim 2, wherein the determination unit selects a driving pulse table based on a distance between the portion of the element array used for printing and the temperature sensor.

5. The apparatus according to claim 1, further comprising a changing unit configured to change the portion of the element array used for printing during a printing operation for a printing medium, wherein when the changing unit changes the portion, the determination unit selects a driving pulse table so that an energy amount of a driving pulse in a driving pulse table before the changing unit changes the portion matches an energy amount of a driving pulse in a driving pulse table after the changing unit changes the portion.

6. The apparatus according to claim 1, further comprising a correction unit configured to correct a pulse width of the determined driving pulse or a driving voltage based on a number of heat generation elements to be driven simultaneously.

7. The apparatus according to claim 6, wherein the correction unit corrects to set a constant ink discharge amount.

8. The apparatus according to claim 1, wherein the obtaining unit obtains the information based on a plurality of print modes set according to print qualities.

9. The apparatus according to claim 1, wherein the obtaining unit obtains the information based on a position of a printing medium to be printed by the printhead.

10. A method of determining a driving pulse applied in an inkjet printing apparatus including a printhead including a temperature sensor and an element array formed by arraying a plurality of heat generation elements, each of which generates thermal energy required to discharge ink in response to application of a driving pulse, the printhead being configured such that a portion of the element array used for printing is changeable, the method comprising:

obtaining information relating to the portion of the element array to be used for printing;

sensing a temperature of the printhead using the temperature sensor; and determining a driving pulse, to be applied to the respective heat generation elements, for discharging the ink for printing, according to the temperature of the printhead sensed in the sensing and according to the portion of the element array used for the printing determined based on the information obtained in the obtaining.

11. The method according to claim 10, wherein the determining includes:

selecting one driving pulse table from a plurality of driving pulse tables required to define a plurality of driving pulses based on the information obtained in the obtaining; and determining a driving pulse to be applied to the heat generation elements from the driving pulse table selected in the selecting based on the temperature of the printhead sensed in the sensing.

12. The method according to claim 11, wherein the plurality of driving pulses in a first driving pulse table selected when the number of heat generation elements included in the portion is a first number is defined so that a ratio of an increase in target ink discharge amount according to an increase in temperature of the printhead is higher than that for the plurality of driving pulses in a second driving pulse table selected when the number of heat generation elements included in the portion is a second number greater than the first number.

13. An inkjet printing apparatus comprising:

a printhead including a temperature sensor and an element array formed by arraying a plurality of heat generation elements, each of which generates thermal energy required to discharge ink in response to application of a driving pulse;

a mode setting unit configured to set an executing print mode from among a plurality of print modes which include a first print mode and a second print mode, wherein a number of heat generation elements used for printing in the element array is a first number when the first print mode is executed, and a number of heat generation elements used for printing in the element array is a second number greater than the first number when the second print mode is executed; and a determination unit configured to determine a driving pulse, to be applied to respective heat generation elements, for discharging the ink for printing, according to a temperature of the printhead sensed by the temperature sensor and the print mode set by the mode setting unit.

14. The apparatus according to claim 13, wherein the first print mode is a mode in which the printing is performed by using a part of the element array, and the second print mode is a mode in which the printing is performed by using whole of the element array.

15. An inkjet printing apparatus comprising:

a printhead including a temperature sensor and an element array formed by arraying a plurality of heat generation elements, each of which generates thermal energy required to discharge ink in response to application of a driving pulse;

a mode setting unit configured to set an executing print mode from among a plurality of print modes which include a first print mode and a second print mode, wherein a number of heat generation elements used for printing in the element array is a first number when the first print mode is executed, and a number of heat generation elements used for printing in the element array is a second number greater than the first number when the second print mode is executed;

a determination unit configured to determine a driving pulse, to be applied to respective heat generation elements, for discharging the ink for printing, according to a temperature of the printhead sensed by the temperature sensor and the print mode set by the mode setting unit; and a storage unit configured to store a plurality of driving pulse tables required to define a plurality of driving pulses, wherein the determination unit selects one driving pulse table from among the plurality of driving pulse tables stored in the storage unit based on the executing print mode set by the mode setting unit, and determines the driving pulse to be applied to the respective heat generation elements from the selected driving pulse table based on the temperature of the printhead sensed by the temperature sensor, and wherein the plurality of driving pulses in a first driving pulse table selected when the first print mode is set as the executing print mode is defined so that a ratio of an increase in target ink discharge amount according to an increase in a temperature of the printhead is higher than that for the plurality of driving pulses in a second driving pulse table selected when the second print mode is set as the executing print mode.

* * * * *